US007285899B2

(12) United States Patent
Nishimura et al.

(10) Patent No.: US 7,285,899 B2
(45) Date of Patent: Oct. 23, 2007

(54) FLUORESCENT LAMP HAVING BENT PORTIONS AND ITS MANUFACTURING METHOD, AND ILLUMINATING APPARATUS INCLUDING THE LAMP

(75) Inventors: Kiyoshi Nishimura, Kanagawa-Ken (JP); Miho Watanabe, Kanagawa-Ken (JP); Yusuke Shibahara, Kanagawa-Ken (JP); Kiyoshi Ootani, Kanagawa-Ken (JP); Ichiro Yamada, Kanagawa-Ken (JP); Takashi Yorifuji, Kanagawa-Ken (JP); Naoyuki Toda, Kanagawa-Ken (JP); Hajime Oono, Kanagawa-Ken (JP); Kazuo Egawa, Kanagawa-Ken (JP); Masahiko Yoshida, Kanagawa-Ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 306 days.

(21) Appl. No.: 10/526,046

(22) PCT Filed: Sep. 1, 2003

(86) PCT No.: PCT/JP03/11136
§ 371 (c)(1),
(2), (4) Date: Feb. 28, 2005

(87) PCT Pub. No.: WO2004/021396
PCT Pub. Date: Mar. 11, 2004

(65) Prior Publication Data

US 2006/0164000 A1 Jul. 27, 2006

(30) Foreign Application Priority Data

| | | |
|---|---|---|
| Aug. 30, 2002 | (JP) | 2002-256015 |
| Sep. 30, 2002 | (JP) | 2002-288162 |
| Nov. 20, 2002 | (JP) | 2002-337206 |
| Nov. 20, 2002 | (JP) | 2002-337243 |
| Dec. 11, 2002 | (JP) | 2002-359251 |

(51) Int. Cl.
*H01J 1/62* (2006.01)
*H01J 63/04* (2006.01)

(52) U.S. Cl. ..... 313/485; 313/484

(58) Field of Classification Search ..... 445/22, 445/26, 27; 313/484–489
See application file for complete search history.

(56) References Cited

U.S. PATENT DOCUMENTS 4,337,414 A 6/1982 Young (Continued)

FOREIGN PATENT DOCUMENTS

EP 0 662 704 A1 7/1995

(Continued)

OTHER PUBLICATIONS

U.S. Appl. No. 10/526,046, filed Feb. 28, 2005, Nishimura et al.
U.S. Appl. No. 11/125,180, filed May 10, 2005, Shibahara et al.

*Primary Examiner*—Joseph Williams
*Assistant Examiner*—Bumsuk Won
(74) *Attorney, Agent, or Firm*—Oblon, Spivak, McClelland, Maier & Neustadt, P.C.

(57) ABSTRACT

A fluorescent lamp includes: a bulb including bent and straight-tube portions having an external tube diameter of 12 to 20 mm and a tube length of 800 to 2500 mm. The straight portions are disposed generally within the same plane through the bent portions. A pair of end portions with electrodes sealed therein form a single discharge path through the straight tube and bent portions. A phosphor layer is formed on the inner face of the bulb, and a discharge medium including mercury is sealed in the bulb. Thermal deterioration of the phosphor layer formed at the straight tube portions is reduced so deterioration of the initial light flux is suppressed, allowing lighting at higher efficiency. With the above configuration, a fluorescent lamp is compact and capable of light with high efficiency, and with improved light output properties. A light fixture uses this fluorescent lamp.

18 Claims, 24 Drawing Sheets

U.S. PATENT DOCUMENTS

| | | | | |
|---|---|---|---|---|
| 4,458,301 | A | 7/1984 | Chapman et al. | |
| 4,549,251 | A * | 10/1985 | Chapman et al. | 362/216 |
| 5,769,530 | A * | 6/1998 | Biro et al. | 362/216 |
| 5,775,801 | A | 7/1998 | Shaffer | |
| 6,515,437 | B1 * | 2/2003 | Zinkler et al. | 315/312 |

FOREIGN PATENT DOCUMENTS

| | | |
|---|---|---|
| GB | 2 137 017 A | 9/1984 |
| JP | 52-149886 | 12/1977 |
| JP | 58-103760 | 6/1983 |
| JP | 58-152366 | 9/1983 |
| JP | 59-020959 | 2/1984 |
| JP | 61-126733 | 6/1986 |
| JP | 62-133663 | 6/1987 |
| JP | 02-003649 | 1/1990 |
| JP | 06-076797 | 3/1994 |
| JP | 06-187948 | 7/1994 |
| JP | 08-273607 | 10/1996 |
| JP | 08-329891 | 12/1996 |
| JP | 09-320525 | 12/1997 |
| JP | 2001-345065 | 12/2001 |
| JP | 2002-075276 | 3/2002 |
| JP | 2002-170526 | 6/2002 |
| JP | 2002-245808 | 8/2002 |

* cited by examiner

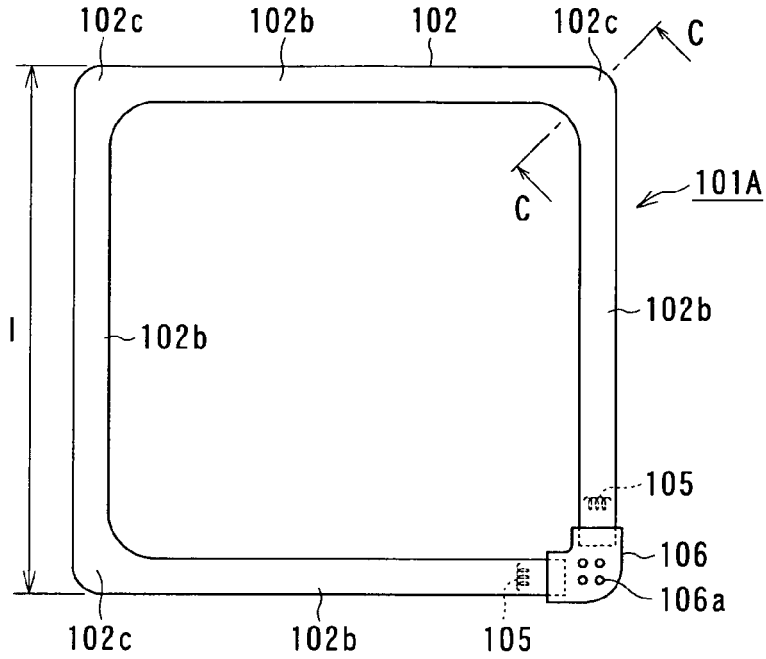
FIG. 16
FIG. 17(a)
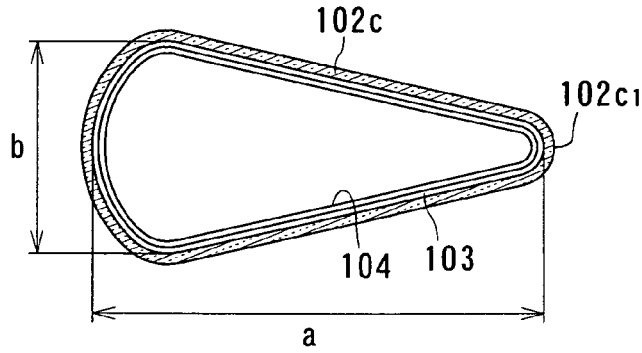
FIG. 17(b)
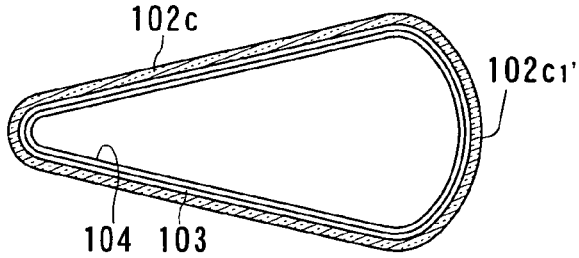

FLUORESCENT LAMP HAVING BENT PORTIONS AND ITS MANUFACTURING METHOD, AND ILLUMINATING APPARATUS INCLUDING THE LAMP

TECHNICAL FIELD

The present invention relates to a fluorescent lamp and a manufacturing method thereof, and to a lighting apparatus using the fluorescent lamp.

BACKGROUND ART

Fluorescent lamps of straight tube shapes, ring shapes, and single-ended shapes are known as general fluorescent lamps, and particularly, in view of recent demands for energy conservation and conservation of resources, a small-diameter ring-shaped fluorescent lamp for high-frequency lighting has been developed and produced as a product. This small-diameter ring-shaped fluorescent lamp is identified by the name "FHC" in products (see Patent Document 1). This small-diameter ring-shaped fluorescent lamp has approximately the same external diameter for the ring size as that of conventional ring-shaped fluorescent lamps, but the external diameter of the tube is made to be smaller, while ensuring brightness equal to or greater than that of the conventional ring-shaped fluorescent lamps, thereby satisfying the needs for energy conservation and conservation of resources and, particularly, allowing a comfortable visual environment to be realized in the home space.

On the other hand, a square-shaped fluorescent lamp has been conventionally known (see Patent Documents 2 and 3). The fluorescent lamp described in the Patent Document 2 is a 30 W type square fluorescent lamp using a quadrate bulb having an external diameter for the tube of 25 to 32 mm, a curvature radius at the inner side of the bent portions of 20 to 40 mm, and an external diameter of 190 to 220 mm between opposing straight portions. The fluorescent lamp described in the Patent Document 3 is square fluorescent lamp using a quadrate bulb having an external diameter for the tube of 12.75 to 13.25 mm, an external diameter of 135 mm between opposing straight portions, and a discharge path length of 450 to 470 mm (tube length 500 to 520 mm).

[Patent Document 1] Japanese Patent No. 3055769

[Patent Document 2] Japanese Patent Laid-open Publication No. SHO 58-152365

[Patent Document 3] Japanese Patent Laid-open Publication No. HEI 3-59548

The small-diameter ring-shaped fluorescent lamp according to the Patent Document 1 is manufactured by forming a protective layer and phosphor layer in a straight tube bulb, the sealing electrodes to both ends, heating so that the entire straight tube bulb becomes soft, and bending the straight tube bulb into a ring shape, so that the initial light flux tends to be lower due to thermal deterioration of the phosphor layer. Further, alkali component in the bulb precipitates due to the heating process and reacts with the phosphor layer, thus providing problems of being easily deteriorated in time elapsing and easily deteriorating the lumen maintenance factor.

Moreover, small-diameter ring-shaped fluorescent lamps are formed into the ring shape by a straight tube bulb while being stretched in the longitudinal direction, which easily results in the cracking of the protective layer and phosphor layer formed in the straight tube at the time of shaping, thus providing a problem that the protective layer and phosphor layer cannot be formed thickly. Generally, the thicker the phosphor layer is formed, the more the initial light flux improves, and a thicker protective layer allows the luminous flux maintenance factor to be improved. However, with small-diameter ring-shaped fluorescent lamps, the protective layer and phosphor layer cannot be formed thickly by the reasons mentioned above, so that there has been a limit to the extent of improvement in initial light flux and improvement in luminous flux maintenance factor.

The square fluorescent lamp according to the Patent Document 2 simply shapes a common large-diameter 30 W fluorescent lamp into a square, and no consideration has been given to the bulb shaping process or improvement in lamp properties.

Since the square fluorescent lamp according to the Patent Document 3 has a short tube length of 500 to 520 mm, the light output is low, and high-output lighting as like as in the conventional small-diameter ring-shaped fluorescent lamps cannot be expected. Particularly, the external diameter between opposing straight portions of 135 mm is so short that a pair of electrodes must be disposed in a manner bent toward the inner side of the bulb, leading to inconveniences such that manufacturing is complicated, and that concentric combination arrangements of the same type of bulbs with the same shape but different dimensions cannot be used.

It is an object of the present invention to provide a fluorescent lamp which is small in size, highly efficient, and has improved light output properties, and a lighting apparatus using this fluorescent lamp.

DISCLOSURE OF THE INVENTION

The fluorescent lamp of the present invention comprises:

a bulb formed by: heating a bent-portion-formation preordination portion of a single straight-tube-shaped bulb member having an external tube diameter of 12 to 20 mm and a tube length of 800 to 2500 mm so as to provide a plurality of bent portions and straight tube portions adjacent to the bent portions by bending working, such that the straight portions are disposed generally within the same plane through the bent portions; forming in close proximity a pair of end portions with electrodes being sealed therein so as to form a single discharge path through the straight tube portions and bent portions; forming a phosphor layer on the inner surface of the bulb; and sealing a discharge medium including mercury; and a base provided on the end portions of the bulb.

The bulb is formed of a plurality of straight tube portions and bent portions connecting these straight tube portions so as to be communicated with each other. The bent portions are formed by heating bent-portion-formation preordination portions on a single straight-tube-shaped bulb and bending the portions. This may be formed by bending multiple straight-tube-shaped bulbs and connecting the end portions one another.

The bent portions may be a straight-tube-shaped bulb which is simply bent or may be shaped by wrapping on drum or by molding so that the cross-sectional shape of the bent portion is approximately the same shape as that of the straight tube portion.

The tube length of the straight-tube-shaped bulb is approximately the same as the discharge path length, and accordingly, it is necessary for the tube length to be within the range of 800 to 3000 mm, preferably within the range of 800 to 2500 mm, taking into consideration yielding light output equivalent to that of conventional small-diameter ring-shaped fluorescent lamps.

The inner diameter of the straight tube portion is within the range of 12 to 20 mm, and the optimal range of the inner diameter of the straight tube portion is 14 to 18 mm, taking into consideration lamp properties such as lamp efficiency and manufacturing conditions. It is to be noted that although the straight tube portion close to the bent portions may have an external diameter, which has changed, not within the above range due to the shaping of the bent portion, it is sufficient for the present invention that the greater part of the straight tube portion is within the range mentioned above.

It is known that generally, the smaller the tube diameter of a fluorescent lamp is, the more the lamp efficiency improves, and in the present invention, the external tube diameter of the straight portions is 20 mm or smaller. An external tube diameter of 20 mm or smaller for the straight portions enables the lamp efficiency equivalent to that of conventional small-diameter ring-shaped fluorescent lamps to be realized. On the other hand, an arrangement of the external tube diameter of the straight portion being smaller than 12 mm is not acceptable because it is difficult to ensure the mechanical strength of the glass bulb having the bent portion, and also such arrangement is impractical because the lamp efficiency equivalent to that of conventional ring-shaped fluorescent lamps of the same size is not obtainable.

In order to improve the lamp efficiency of the conventional ring-shaped fluorescent lamp having an external tube diameter of 29 mm (type name "FCL") by 10% or more, the external tube diameter needs to be reduced to 65% or smaller. That is, it will be necessary to provide an external tube diameter of 18 mm or smaller for the straight tube portion. Further, it is sufficient for the external tube diameter to reduce the thickness of the fluorescent lamp. Taking the properties such as light output and lamp efficiency into consideration, it is preferred that the external tube diameter at the straight tube portions is 14 mm or more.

A bulb has three or more straight tube portions, and the bent portions for connecting the straight tube portions are formed with the number less, by one, than number of the straight tube portions. The bent portions are formed such that the straight tube portions are positioned substantially within the same plane. Electrodes are sealed in the end portions of the straight tube portions disposed at both ends at which no bent portion is provided, so that both end portions of the electrodes are closely positioned.

The bulb forms a single discharge path surrounding substantially the center in the positional relation of the multiple straight tube portions. That is, in the bulb, the interior of the straight tube portions is connected by the bent portions, and a single discharge path is formed by the pair of electrodes sealed in both end portions. Further, the straight tube portions need not to have the same length, and an arrangement, in which only one having a different length is disposed, may be adopted. In a case where four straight tube portions having the same tube length are connected with three bent portions, the bulb will provide approximately quadrate shape due to the straight tube portions.

It is sufficient that the shape of the bulb has a polygonal shape, which is not limited thereto, and the bulb may have a pentagonal or hexagonal shape. Furthermore, there may be further adopted that an arrangement in which two bulbs having different lengths of each side are concentrically disposed on the same plane, one on the inner side and the other on the outer side, and the end portions of the bulbs may be connected in an airtight manner so as to form a double tube.

The phosphor layer is to be coated and formed on the inner surface of the straight-tube-shaped bulb before shaping the bent portions.

The base has an electrical connecting portion connected to a supply member such as a socket. This connecting portion may be provided at a position apart form both end portions of the bulb. Further, the base may have a configuration serving as a holding portion through a mechanical connection to the supply member.

According to the present invention, only the bent-portion-formation preordination portions of a straight-tube-shaped bulb having an external tube diameter of 12 to 20 mm are heated so as to be softened, and bent portions are formed so that the thermal deterioration of the phosphor layer formed at the straight tube portions is alleviated and the depreciation of the initial light flux is suppressed, thereby lighting the lamp with higher efficiency.

Furthermore, the straight tube portions of the bulb are not bent under the thermal softening, so that cracking or peeling of the phosphor layer and protective layer do not readily occur even in the event that the phosphor layer and protective layer are formed thickly, and poor appearance and deterioration in lumen maintenance factor due to such cracking or peeling can be improved.

According to the fluorescent lamp of the structures and characters mentioned above, the bent-portion-formation preordination portions are preferably bent such that the radius of curvature at the inner side surface of the bent portion is in a range of 1 to 3 times the outer diameter of the tube, and the amount (mg/cm $^2$) of phosphor layer adhering to the bent portions is ½ or more than that at the straight tube portions.

According to an arrangement in which the radius of curvature at the inner side surface of the bent portion is small, the stretching of glass at the outer side of the bent portion is great, and the phosphor layer readily peels. However, with the arrangement of the present invention, a straight tube bulb having an external tube diameter of 12 to 20 mm is bent, so that the stretching of glass at the outer side can be made smaller than that of the conventional straight tube bulb having an external tube diameter of 25 mm or greater. However, in the event that the radius of curvature at the inner side surface is smaller than the external tube diameter, since the peeling of the phosphor layer remarkably occurs, it is necessary for the radius of curvature to be equal to or greater than the external tube diameter. Furthermore, with the bent portion in which the radius of curvature at the inner side surface is more than three times the external tube diameter of the straight tube portion, the percentage of bent portions in the bulb obtained by bending the straight tube bulb with a tube length of 800 to 2500 mm becomes great, thus not expecting the improvement in lamp efficiency. In addition, the shape of the bulb has gradually curving bent portion, so the discharge path length becomes small, and also the appearance of a polygonal bulb is diminished. Thus, the radius of curvature needs to be three times, or smaller than, the external tube diameter of the straight tube portions.

Furthermore, the amount of the phosphor layer adhering to the bent portion is less per area increment (mg/cm $^2$) because the outer side glass portion stretches, but the peeling of the phosphor layer can be made inconspicuous by adjusting the stretching of the glass portion at the outside when bending the bent-portion-formation preordination portion so that the amount adhering becomes ½ of or more than that at the straight tube portion, and the desired light output is also obtainable from the bent portion.

The bent portion is defined herein as a region between points at which the curving inner surface and outer surface meet to the outer peripheral surface of the adjacent straight tube portions. Accordingly, while this matter may not necessarily accord with the bent-portion-formation preordination portions of the straight-tube-shaped bulb, it is of course desirable that the bending working is carried out with small difference therebetween.

According to the above fluorescent lamp, the application amount of fluorescent substance particles at the straight tube portions is preferably 4.0 to 7.5 mg/cm$^2$. In the event that the application amount is less than 4.0 mg, the advantage in the improvement in the light output over the conventional small-diameter ring-shaped fluorescent lamps will be reduced. On the other hand, in the event that the application amount of fluorescent substance particles at the straight tube portions exceeds 6.0 mg/cm$^2$, the phosphor layer may begin to be peeled at the bent portions, and when exceeding 7.5 mg/cm$^2$, an advantage in the improvement in the light output due to the increasing of the thickness of the phosphor layer will not remarkably appear.

Accordingly, with an application amount of phosphor particles making up the phosphor layer at the straight tube portions of 4.0 to 7.5 mg/cm$^2$, the light output can be improved, and by setting this range to 4.0 to 6.0 mg/cm$^2$ the cracking and peeling of the phosphor layer can be suppressed at the straight tube portions.

Furthermore, according to the above fluorescent lamp, the bent-portion-formation preordination portions has a length in a range of 5 to 50% of the entire length of the straight-tube-shaped bulb, preferably within a range of 15 to 50%.

The greater the percentage of the straight tube portions, which have small thermal deterioration of the phosphor layer, is as to the entire bulb, the smaller the deterioration in the initial light flux is, and the greater the improvement in the light output is. Accordingly, the length of the bent-portion-formation preordination portions is 50% of the entire length of the straight-tube-shaped bulb or less. In the event that the length of the bent-portion-formation preordination portions exceeds 50%, the amount of phosphor layer which deteriorates due to the heat at the time of bending will be increased, and improvement in the light output is made worse. On the other hand, in the event that the length of the bent-portion-formation preordination portions is less than 5%, it becomes difficult to bend the portions to be bent, and it is also difficult to obtain a required mechanical strength of the bent portions.

With the arrangement mentioned above, since the length of the bent-portion-formation preordination portions is within a range of 5 to 50% of the entire length of the straight-tube-shaped bulb, the length of the straight tube portions, which have small thermal deterioration of the phosphor layer, becomes suitably great. Accordingly, it is easy to be manufactured, the mechanical strength can be ensured, and a fluorescent lamp with the high improvement in the light output can be realized.

According to the fluorescent lamp of the characters mentioned above, a protective layer of 0.5 μm or more in thickness may be formed on the inner surface of the bulb.

In the event that the protective layer has a thickness of 0.5 μm or more, cracking of the phosphor layer or protective layer at the bent portions could be suppressed, and also reaction between the alkali component in the bulb and mercury, and the phenomenon of mercury injection into the bulb can be expected to be suppressed, thereby reducing consumption of the mercury during the lighting of the lamp. Moreover, since the straight tube portion is not essentially stretched, there is no fear of cracking or the like of the protective layer at the straight tube portion during the bending process even in the event that the thickness of the protective layer formed in the straight-tube-shaped bulb is increased to 0.5 μm or more, so that the functions of the protective layer can be fully manifested.

In addition, according to the present invention, in the case of the fluorescent lamp protective layer having the thickness of 0.5 μm or more, in addition to the function of the protective layer, the amount of mercury consumption is greatly reduced in conjunction with the straight tube portions not being directly heated to the point of softening. Accordingly, even with 0.15 mg/W or less mercury sealed in per lamp wattage, it has been confirmed that the mercury is not depleted during the rated life expectancy of the lamp, and the lamp can remain lighting throughout.

In the above fluorescent lamp, the bulb is formed in an approximately quadrate shape from five straight tube portions, with bent portions formed at each of the diagonal line positions of the quadrate shape, with a base provided on both end portions of the bulb at substantially the center of one side of the quadrate shape.

According to this configuration, a light source, in which the light emission portion forms the sides of the quadrate shape, can be provided, and the base is disposed substantially at the center of one side of the quadrate shape, so that both the end portions of the bulb are disposed on substantially the same line, thereby enabling the structure for attaching the base to be simplified.

Preferably, the fluorescent lamp of the structure mentioned above further comprises a turn restricting member for restricting the turning angle of the base with respect to both the end portions of the bulb to within a predetermined angle.

According to this configuration, turning of the base over a predetermined angle can be restricted by the turn restricting member so as to prevent outer leads, which are connected to the pair of electrodes, then extend through both the end portions of the bulb in an airtight manner outside and are connected to the terminals of the base such as pins, from being pulled and broken, or to prevent the end portions of the bulb from being broken or prevent the damage of the lighting circuit due to the pair of outer leads short-circuiting one another, or from being pulled off of the portion fused to the base pins or the like.

The turning restriction angle is preferably within 45° for both forward and reverse turning directions. This is based on the reason that the connectable range with the electric supply socket on the lighting apparatus side can be enlarged by suitably adjusting the position of the base pins while turning the base in the forward and reverse directions within 45° each, while preventing damage of the lighting circuit and breakage of the end portions of the glass bulb due to breaking of the outer leads and short-circuiting of the pair of outer leads one another.

Furthermore, according to the above fluorescent lamp, the turn restricting members are configured by both the base and both end portions of the bulb to which the base is fitted so as to provide an elliptical shape in its axial cross-sectional shape.

According to this configuration, both the base and the end portions of the bulb to which the base is fitted have the elliptical axial cross-sectional shapes, thus preventing the turning of the base. Accordingly, the braking or coming loose of both the outer leads, damage of the lighting circuit and breakage of the end portions of the bulb due to the short-circuiting of the pair of outer leads, and breaking of the bulb ends, can be prevented.

In the above fluorescent lamp, the turn restricting members are formed on at least one of both the joint portions of the base and the end portions of the bulb to which the base is fitted and may be constituted as retaining members for restricting the turning of the base exceeding a predetermined angle by retaining the base.

According to this configuration, the turning restriction angle can be set by the retaining members in an accurate manner.

The present invention further provides a fluorescent lamp comprising:

a bulb formed by: connecting a plurality of straight tube portions having an external tube diameter of 12 to 20 mm within a same plane through bent portions; forming in close proximity a pair of end portions with electrodes being sealed therein so as to form a single discharge path through the straight tube portions and bent portions; forming a phosphor layer on an inner surface of the bulb; and sealing a discharge medium including mercury; and a base provided on the end portions of the bulb, wherein a coldest portion to be maximally cooled is formed to at least one of the bent portions at a time of lighting.

With the fluorescent lamp according to this invention, the coldest portions are formed at the bent portions of the bulb having straight tube portions with an external tube diameter of 12 to 20 mm, so that the coldest portions can be ensured without reducing the discharge path by extending the distance from the electrodes to the bulb ends more than necessary, thereby further improving the lamp efficiency.

According to the above fluorescent lamp, the maximum length of the inner tube diameter at the bent portions is preferably 1.2 times the inner tube diameter of the straight tube portions, or more.

The inner tube diameter at the bent portion mentioned herein means the inner diameter in the direction orthogonal to the axial center of the discharge path, and in a case that the cross-sectional shape of the bent portion in this direction is not a true circle, this means the greatest width dimension within the cross-section.

In order to form the coldest portion, it is necessary to enlarge a so-called non-discharge region in which no discharge is formed. However, in the bulb having an outer tube diameter of the straight tube portion of 12 to 20 mm, it was confirmed through an experiment that the desired coldest portion temperature could be substantially ensured with an inner tube diameter, at the bent portions, 1.2 times or more the inner tube diameter at the straight tube portions, though this depends on the magnitude of the input electric power. Further, in order to further ensure the coldest portion, the inner tube diameter at the bent portion is preferably 1.5 times the inner tube diameter of the straight tube portion, or more. Moreover, taking into consideration the mechanical strength of the bent portion, the inner tube diameter at the bent portion is preferably 2.5 times or less the inner tube diameter of the straight tube portion, and more preferably, 1.8 times or less.

According to this configuration, the coldest portions are formed at the bent portions of the bulb having straight tube portions with an external tube diameter of 12 to 20 mm, so that the desired coldest portions can be secured without reducing the length of the discharge path, further improving the lamp efficiency.

The above fluorescent lamp preferably lights at a tube wall load of 0.05 W/cm$^2$ or higher.

The tube wall load means, herein, the lamp input electric power per inner surface area of the bulb, and the greater the tube wall load is, greater the amount of the heat emitted is, so that the bulb temperature tends to be higher. Further, it is to be noted that the term of "inner surface area of the bulb" used herein does not mean the inner surface area of the entire bulb but rather means the inner surface area of the bulb at regions where the discharge path is formed.

In a case that the bulb temperature is high, the mercury vapor pressure within the bulb rises and exceeds the optimal temperature, and it is necessary to form the coldest portions in the bulb. Particularly, in a case that the tube wall load is 0.05 W/cm$^2$ or higher, experiment shows that the forming of the coldest portion according to the present invention makes the mercury vapor pressure appropriate and the lamp efficiency can be further improved. This advantage is manifested further markedly in cases that the tube wall load is 0.1 W/cm$^2$ or higher.

With such a configuration, the fluorescent lamp lights at a tube wall load of 0.05 W/cm$^2$ or higher, and the mercury vapor pressure is made appropriate and the lamp efficiency can be further improved.

According to the above fluorescent lamp, at the bent portions, the tip of one adjacent straight tube portion may be formed so as to extend and protrude in the axial direction of the straight tube portion over the connecting portion.

By forming the bent portions such that the tip of a straight-tube-shaped bulb protrudes over the connecting position of an adjacent straight-tube-shaped bulb, this protruding region constitutes a non-discharge region of this protruding region, thus forming the coldest portion. Accordingly, a desired coldest portion can be formed simply by protruding the tip of the straight-tube-shaped bulb without forming the bent portion into special shape.

According to such a configuration, the coldest portion can be formed at the bent portion simply by protruding the tip of a straight-tube-shaped bulb, thereby facilitating the formation of the bent portion.

The present invention further provides a fluorescent lamp comprising:

a discharge vessel having a glass bulb formed by partially bending a glass tube having an external tube diameter of 12 to 20 mm and a tube length of 800 to 3000 mm so as to form a plurality of straight tube portions and bent portions, which are alternately adjacently arranged, within a same plane, such that both end portion provide straight tube portions so as to be adjacent one another so as to provide entirely a polygonal shape, the glass bulb being provided with a pair of sealed fine tubes for discharge extending from both end portions of the glass bulb, a phosphor layer formed on the inner surface side of the glass bulb, a pair of electrodes sealed on an inner side of both end portions of the glass bulb, and a discharge medium sealed within the glass bulb; and a base provided to both the end portions of the bulb.

According to this invention, since a discharge medium is sealed after exhausting from each of a pair of fine tubes, the exhausting is performed well even though the slender and long discharge vessel having an outer tube diameter of 12 to 20 mm and a tube length of 800 to 3000 mm provides a polygonal shape. Thus, residual impure gasses in the discharge vessel can be reduced. Consequently, the luminous flux maintenance factor of the fluorescent lamp can be improved.

With the above fluorescent lamp, a part of at least one of the paired fine tubes is bent so that the pair of fine tubes extend approximately in parallel to each other.

With such a configuration, the manufacturing processes of the present invention will become easier. That is, according to the arrangement in which the tip portions of the paired fine tubes are parallel, the pair of fine tubes can be easily connected to a vacuum pump head, and also the manufacturing facilities can be simplified in construction. Further, the gas cleansing before exhaust or evacuation can be performed easily by using the paired fine tubes. Furthermore, the process is facilitated at the time of sealing in the discharge medium after the exhaust or exhaust.

The present invention further provides a method of manufacturing a fluorescent lamp of the structures mentioned above, which comprises the steps of:

forming a discharge vessel having a straight-tube-shaped glass bulb, in which a phosphor layer is disposed on an inner surface of a glass tube having an external tube diameter of 12 to 20 mm and a tube length of 800 to 3000 mm, and electrode mounts for supporting electrodes and having a pair of fine tubes are sealed at the end portions of the glass tube;

shaping the discharge vessel, in which the straight-tube-shaped glass bulb is partially heated to be softened and then bent so as to alternately form a plurality of tube portions so as to be adjacent to each other and bent portions within a same plane such that both the end portions constitute straight tube portions and are adjacent one another so as to provide an entirely polygonal shape;

exhausting the interior of the discharge vessel from each of the paired fine tubes extending from the end portions of the glass bulb following the discharge vessel shaping step and, subsequently, sealing in a discharge medium and then sealing off the fine tubes; and disposing a base on both end portions of the discharge vessel.

In the above method, the exhausting/sealing step is a step for exhausting the interior of the discharge vessel from the pair of fine tubes extending from the ends of the glass bulb after the shaping step of the discharge vessel, and the sealing in the discharge medium and subsequently sealing off the fine tubes. In this process, the exhausting step is a step for performing the exhaust, i.e., exhaust, simultaneously from both ends of the discharge vessel through the pair of fine tubes. Inert gas cleansing may be performed in advance of the exhausting step. In this case, the cleansing can be performed through the pair of fine tubes.

The sealing of the discharge medium is performed by utilizing one or both of the paired tubes. Mercury vapor is sealed into the discharge vessel through the fine tubes in form of either one of pure mercury or amalgam.

The interior of the discharge vessel is evacuated, and then, the discharge medium is sealed therein. Subsequently, the paired fine tubes are sealed off by closing the valve of the tube connecting to the device for sealing the discharge medium and heating the middle portion of the fine tube by a gas burner. Thus, the heated glass portion is melted and cut off, and the molted tip portion invades into the fine tube, and is then hardened, due to the low pressure within the discharge vessel and hardens. Consequently, the structure, in which the tip ends of the paired fine tubes have the inwardly protruding inner surfaces, which is one subject feature of the present invention, can be provided.

As mentioned above, according to the present invention, since the exhaust of the discharge vessel is simultaneously performed through the pair of fine tubes extending from both ends of the glass bulb, the exhaust is performed sufficiently surely even in a case that the discharge vessel has a polygonal shape. Accordingly, the luminous flux maintenance factor of the obtained fluorescent lamp can be improved.

In the fluorescent lamp mentioned above, the pair of fine tubes preferably extend in the horizontal direction to the mutually opposing bulb end portion sides and then curved at the curved portion with a radius of curvature of 15 to 30 mm, through which the tip end portions stand upward.

The curvature radius of the curved portions of the pair of fine tubes is 15 to 30 mm, so that the mercury sealing medium such as mercury or amalgam inserted from the fine tubes smoothly moves through the fine tubes by its own weight.

Thus, the mercury can be sealed into the airtight container speedily and surely, and the efficiency of the sealing treatment can be improved.

Further, in the case where the curvature radius of the curved outer end portions of the paired fine tubes is smaller than 15 mm, the curving degree of this curved portion becomes sharply closer to a right angle, leading to a problem that the difficulty in the insertion of the mercury into the fine tube outer end portions increases further.

On the other hand, in the case where the curvature radius of the curved portions exceeds 30 mm, the erecting angle of the curved portions is conversely a blunt angle. Accordingly, since there increases the amount of enlargement of the erected portions of the fine tubes enlarging toward the sealing end side of the airtight container, which may result in the enlargement of the gap between the paired sealing end portions which do not emit light, inviting a problem of reducing the lamp efficiency.

However, according to the present invention, since the curved portions of the fine tubes have a curvature radius of 15 to 30 mm, such problems can be avoided beforehand.

In addition, according to the fluorescent lamp of the present invention, it is desirable that the center axes of horizontal portions of the paired fine tubes extending in the horizontal directions toward the mutually opposing bulb end portion sides are arranged so as to be offset to each other.

According to this structure, the horizontal portions of the outer end portions of the paired fine tubes (exhaust tubes) are configured such that the center axes thereof are mutually offset so as to extend near the sealing end portion without abutting against the horizontal portions of the outer end portions of the paired fine tubes with each other.

Accordingly, the gap between the pair of sealing end portions, which is a dark portion, can be prevented from enlarging while lengthening the length of the horizontal portions of the pair of fine tubes, thus allowing the radius of curvature of the curved portions to be easily made larger without increasing the dark portion.

Further, the present invention also provides a lighting apparatus, which comprises: a lighting apparatus main unit; a fluorescent lamp disposed in the lighting apparatus main unit and having the structure mentioned hereinbefore; and a high-frequency lighting circuit which lights the fluorescent lamp by applying high-frequency voltage of 10 kHz or higher thereto.

In this invention, the term "lighting apparatus" is a broad concept encompassing all devices using the light emitted from the fluorescent lamp stipulated in claims 1 to 3, including examples such as lighting fixtures, marker lamps, display lamps, advertising lamps, and so forth. Furthermore, the term "lighting apparatus main unit" means the remainder of the lighting apparatus with the fluorescent lamp and the high-frequency lighting circuit removed therefrom. The lighting apparatus is permitted to have a configuration in which the fluorescent lamp lights in a space closed by members such as a light-transmitting globe or shade, for example. However, there may be adopted a configuration in which the fluorescent lamp lights in a state exposed externally. Moreover, the high-frequency lighting circuit is circuit means for lighting the fluorescent lamp with high-frequency, and switching means for the high-frequency output may be provided as desired. The switching means may have a configuration enabling the switching between a low-power mode for high-efficiency lighting of the fluorescent lamp and a high-power mode for high-output lighting of the fluorescent lamp, or a configuration in which these modes are continuously switched therebetween. The switching of such switching means for the lighting circuit adjusts the lighting power of the fluorescent lamp.

The fluorescent lamp is attached according to the shape of the lighting fixture main unit or optical properties of the lighting fixture, and multiple fluorescent lamps of the same shape or different shapes are mounted to the fixture main unit within the same plane or disposed at different heights.

Consequently, according to the present invention, high-frequency lighting of the above fluorescent lamp enables a lighting apparatus which is lightened with the high efficiency to be obtained.

BRIEF DESCRIPTION OF THE DRAWINGS

FIG. 16 is a front view of a fluorescent lamp according to an eleventh embodiment of the present invention.

FIGS. 17(*a*) and (*b*) are cross-sectional enlarged views showing essential portions at a portion taken along the line XVII-XVII in FIG. 16.

REFERENCE NUMERALS

2, 102, 112, 202—glass bulb, 2*a*, 102*a*—straight-tube bulb, 2*b*, 102*b*, 202*b*—straight-tube portion, 2*c*, 101*c*, 201*c*—bent portion, 2*d*, 102*d*, 202*d*—end portion, 1*e*, 201*g*, 201*h*—fine tube, 1*f*—lead wire, 3—protective layer, 4—phosphor layer, 5, 105, 205—electrode, DV—discharge vessel, FL—fluorescent lamp, H—flare stem, M—electrode mount

BEST MODE FOR CARRYING OUT THE INVENTION

The following is a description of an embodiment of the ring-shaped fluorescent lamp and a lighting apparatus according to the present embodiment, with reference to the drawings.

Figure 1:
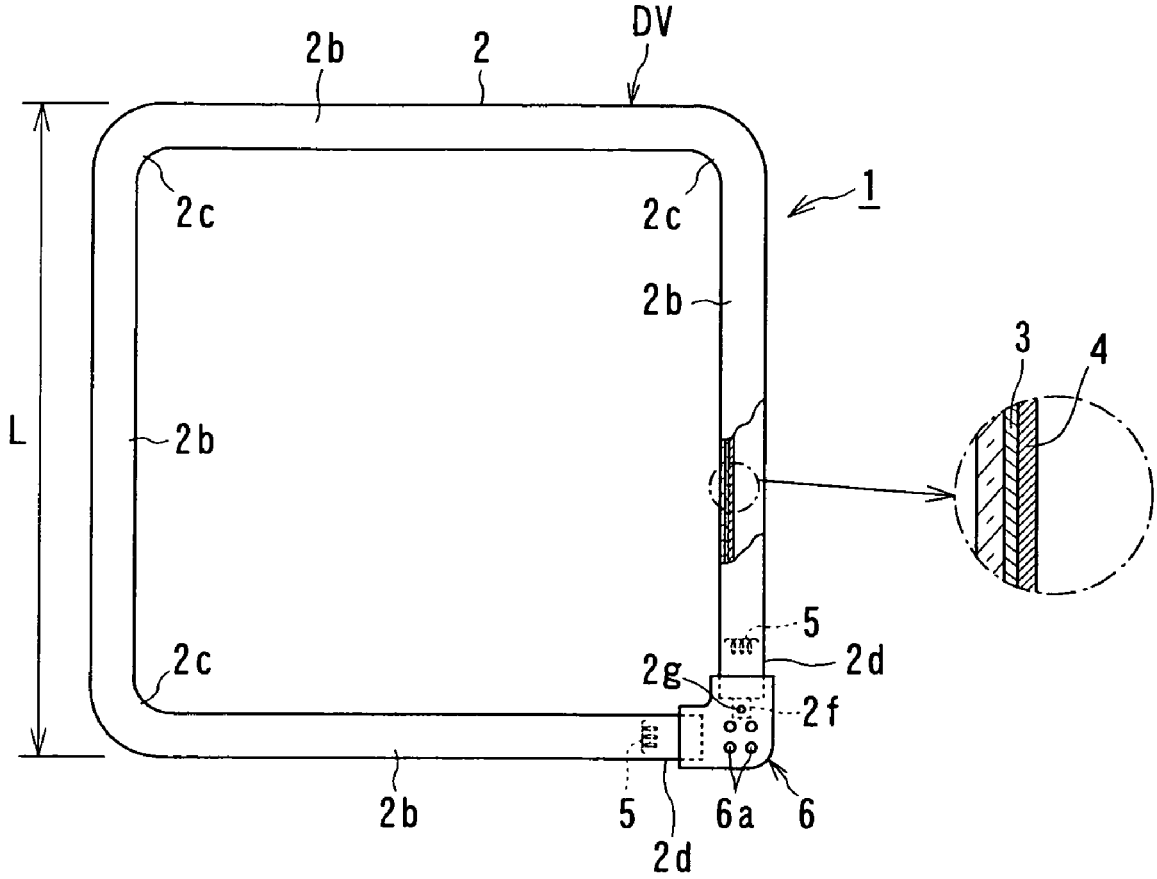
FIG. 1 is a front view of a fluorescent lamp according to a first embodiment of the present invention.
Figure 2A:
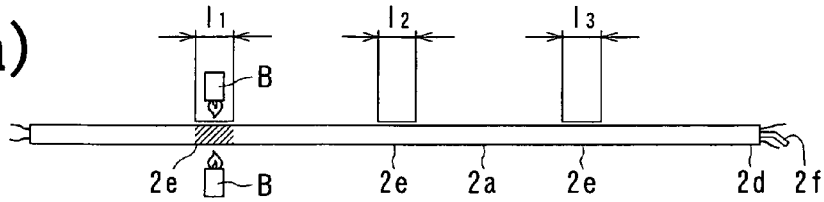
FIGS. 2(*a*), (*b*), (*c*), and (*d*) are schematic illustrations explaining the manufacturing process of the fluorescent lamp shown in FIG. 1.
Figure 2B:
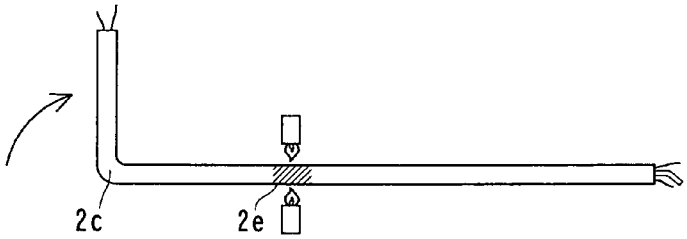
Figure 2C:
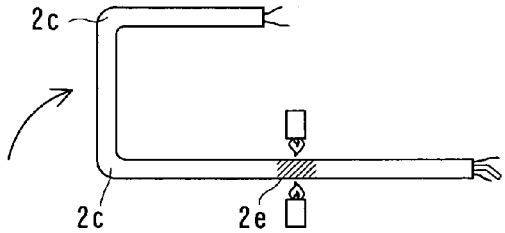
Figure 2D:
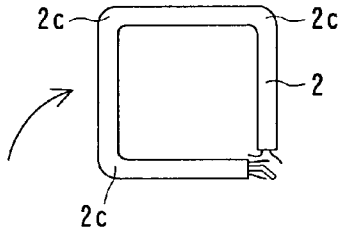

FIG. 1 and FIG. 2 illustrate a first embodiment of the present invention, FIG. 1 being a front view of the fluorescent lamp and FIG. 2 includes illustrations for explaining the manufacturing process of the fluorescent lamp shown in FIG. 1.

In the drawings, reference numeral 1 denotes a fluorescent lamp having a discharge vessel DV and a base 6. The discharge vessel DV is composed of a rectangular glass bulb 2 provided with the straight portions forming a substantially quadrate shape and having the following structure. That is, a discharge medium including a noble gas and mercury is sealed in the glass bulb. The noble gas is argon (Ar) gas, sealed at a pressure of approximately 320 Pa. The other known discharge agents such as neon, krypton, xenon, etc., may be used as the noble gas in addition to or instead of the argon.

A protective layer 3 formed of fine particles of metal oxide is formed on the inner face of the glass bulb 2, and a phosphor layer 4 made up of fine particles of a three-wavelength emission type fluorescent substance is formed on the inner surface of the protective layer 3. The phosphor layer 4 is preferably coated with fine particles of the 3-wavelength emission fluorescent substance. The phosphor layer 4 has a correlated color temperature of 5000 K, the amount thereof being in the range of 4.0 to 7.5 mg/cm$^2$, preferably within the range of 4.0 to 6.0 mg/cm$^2$, and is formed in a film having a thickness of 20 μm by way of a drying/baking process. Further, the coating amount of the protective layer is 0.6 to 0.8 mg/cm$^2$.

Although it is possible to compose the phosphor forming the phosphor layer 4 with a known fluorescent substance such as the 3-wavelength emission fluorescent substance, halo-phosphate fluorescent substance, or the like, it is preferable to use the 3-wavelength emission fluorescent substance in terms of the perspective of emission efficiency.

Examples of such 3-wavelength emission fluorescent substance include, though not limited to, $BaMg_2Al_{16}O_{27}:Eu^{2+}$ as a blue phosphor having an emission peak wavelength around 450 nm, (La, Ce. Tb)$PO_4$ as a green phosphor having an emission peak wavelength around 540 nm, $Y_2O_3:Eu^{3+}$ as a red phosphor having an emission peak wavelength around 610 nm, and so forth.

Further, it is to be noted that, as the fine particles of metal oxide used for the protective layer 3, known ones such as alumina ($Al_2O_3$) or silica ($SiO_2$) having a thickness of 0.5 μm or more may be preferably utilized.

In addition, a protective layer may be formed to have a thickness of approximately 10 to 20 μm by using strontium phosphate ($Sr_2P_2O_7$) fine particles with an average grain diameter of approximately 2.5 μm.

The glass bulb 2 has four straight tube portions 2*b* and three bent portions 2*c*, and the four straight tube portions 2*b* are connected within substantially the same plane so as to form the sides of a quadrate shape. Further, it is desirable for the glass bulb 2 to have a length L, one side thereof, preferably 200 mm or longer, and in this embodiment, the length L is approximately 300 mm. Both end portions 2*d* of the glass bulb 2 are disposed in close proximity, and filament electrodes 5 and 5 formed of triple coils coated with an emitter substance are each sealed at the end portions 2*d*. The electrodes 5 and 5 supported by a pair of lead wires preliminarily sealed to flare stems, not shown so as to provide electrode mounts, and the filament electrodes 5 and 5 are sealed within the bulb by the electrode mounts sealed in both the end portions 2*d* of the glass bulb 2. An exhaust fine tube 2*f* is attached to one flare stem, and amalgam 2*g* for controlling mercury vapor pressure is stored within this fine tube 2*f*.

The outer tube diameter of the straight tube portion 2*b* is 12 to 20 mm, the thickens of the wall of the tube is 0.8 to 1.5 mm, preferably 0.8 to 1.2 mm, and in the case of this embodiment, the inner tube diameter is approximately 16 mm and the thickens of the wall of the tube is approximately 1.2 mm. The interiors of the respective straight tube portions 2*b* are communicated via the bent portions 2*c* so that a single discharge path is formed so as to surround the center of the quadrate shape formed by the straight tube portions 2*b* between the pair of electrodes 5 and 5.

The base 6 is mounted on the end portions 2*d* and 2*d* of the glass bulb 2 so as to straddle the end portions 2*d* and 2*d*. The base 6 is provided with a power supply member 6*a* made up of four pins electrically connected to the pair of electrodes 5 and 5. The fluorescent lamp 1 has three bent portions 2*c* formed at three diagonal positions of the quadrate shape formed by the straight tube portions 2*b* of the glass bulb 2, and the base 6 is disposed at the remaining one diagonal position.

The bent portions 2*c* have approximately the same cross-sectional shape as that of the straight tube portions 2*b*. The cross-sectional shape of the bent portion 2*c* may be approximately triangular or square shape. In a case that the bent portion 2*c* has a shape protruding outward, the discharge path is formed on the inner side. This matter means that the non-discharge region is great, and optimal coldest portions with high cooling effects can be realized, and temperature characteristics can be improved even with no use of the amalgam for controlling the mercury vapor pressure.

FIG. 2(*a*) to (*d*) are views explaining the manufacturing method of the glass bulb 2 for the fluorescent lamp 1 of the structure mentioned above. In the manufacturing method of this glass bulb 2*a*, as shown in FIG. 2(*a*), first, a single circular-tube straight-tube-shaped bulb 2*a* provided with the protective layer 3 and the phosphor layer 4 which were preliminarily formed, and the electrodes 5 and 5 are mounted within the bulb 2 by way of flare stems, not shown, with an exhaust tube 2*f* at one of both end portions 2*d* and 2*d* for introducing the pair of leads.

The pair of electrodes 5 and 5 are composed of hot cathode electrodes, which has a filament coated with an emitter substance, but may be substituted with other electrodes. Further, in a case where high-output lighting performance is required for the lamp, a triple coil is preferably used for the hot cathode electrodes. In addition, the leads supporting the electrodes 5 and 5 may be sealed and supported by members such as a button stem, bead stem, pinch seal, or the like. Further, the stem or the like may be attached thereto a fine tube for exhausting or for storing a mercury alloy.

The entire length of the straight-tube-shaped bulb 2*a* is of 1200 mm and includes three bent-portion-formation preordination portions 2*e* (i.e., portions 2*e* to be formed as bent portions later). The lengths $l_1$, $l_2$, and $l_3$, of the preordination portions 2*e* are approximately 90 mm, respectively, and the total length of the three preordination portions 2*e* is 270 mm, which is approximately 23% of the entire length of the straight-tube-shaped bulb 2*a*.

As shown in FIG. 2(*a*), the bent-portion-formation preordination portion 2*e* is first heated and softened with a gas burner B, and as shown in FIG. 2(*b*), a bending working is performed so that the angle between the adjacent straight tube portions 2*b* constitutes approximately of 90°, and thereafter, a first bent portion 2*c* is formed to a predetermined shape through a molding process or like. Subsequently, the bent-portion-formation preordination portion 2*e* adjacent (continuous) to the first bent portion 2*c* is heated and softened with the gas burner B and subjected to the bending and molding working, thereby forming the second bent portion 2*c* as shown in FIG. 2(*c*). Finally, the bent-portion-formation preordination portion 2*e* adjacent to the second bent portion 2*c* is heated and softened with the gas burner B and subjected to the bending and molding working, thereby forming the third bent portion 2*c* as shown in FIG.

2(*d*). The bulb is then evacuated from the exhaust tube 2*f*, mercury is sealed therein, thus completing the glass bulb 2.

Although the bent portions 2*c* are formed by the bending working, it is not necessary to excessively heat the portions of the straight-tube-shaped bulb 2*a* other than the bent-portion-formation preordination portions 2*e*, so that even in the case of applying the phosphor layer 4 before the formation of the bent portions 2*c*, thermal deterioration of the fluorescent substance does not readily occur, and yielding the advantage that the luminous flux maintenance factor is markedly improved. Such advantages are markedly manifested in the case that the total length of the bent-portion-formation preordination portions 2*e* is 50% or less, preferably 30% or less, and optimally 20% or less, with respect to the entire length of the straight-tube-shaped bulb 2*a*.

The fluorescent lamp 1 may take the following dimensions. For the fluorescent lamp 1 equivalent to an article of conventional 30 W type ring-shaped fluorescent lamp, the entire length L of the glass bulb 2 is formed to be 225 mm, the greatest width on the inner side is 192 mm, the outer tube diameter is 16 mm, and thickness of the wall of the glass bulb 2 is 1.0 mm. The rated lamp power of the fluorescent lamp is 20 W, and the high-output-property lamp power is 27 W when the lamp is lightened. For the fluorescent lamp 1 equivalent to an article of conventional 32 W type ring-shaped fluorescent lamp, the entire length L of the glass bulb 2 is formed to be 299 mm, the greatest width on the inner side is 267 mm, the outer tube diameter is 16 mm, and thickness of the wall of the glass bulb 2 is 1.0 mm. The rated lamp power of the fluorescent lamp is 27 W, and the high-output-property lamp power is 38 W when the lamp is lightened. For the fluorescent lamp 1 equivalent to an article of conventional 40 W type ring-shaped fluorescent lamp, the entire length L of the glass bulb 2 is formed to be 373 mm, the greatest width on the inner side is 341 mm, the outer tube diameter is 16 mm, and thickness of the walls of the glass bulb 2 is 1.0 mm. The rated lamp power of the fluorescent lamp is 34 W, and the high-output-property lamp power is 48 W when the lamp is lightened.

The fluorescent lamp of this embodiment will operates as follows. The fluorescent lamp 1 is supplied with high-frequency electric power input through the power supply member 6*a* of the base 6 and is lightened through the low-pressure mercury vapor discharging in the bulb 2. The fluorescent lamp 1 is lightened with the lamp input power of 20 W or more, lamp current of 200 mA or more, tube wall load of 0.05 W/cm$^2$ or higher, and the lamp efficiency of 50 lm/W or more. Further, the lamp current density, as the lamp current per cross-sectional area of the straight tube portion 2*b*, is 75 mA/cm$^2$ or higher. In the case of the present embodiment, the lamp input power is 50 W, the lamp current is 380 mA, and the lamp efficiency is 90 lm/W.

Amalgam may be sealed in the bulb 2. For example, amalgam such as zinc-mercury may be sealed in order to seal in a predetermined amount of mercury. By enclosing the amalgam for controlling the mercury vapor in the bulb, the ambient temperature becomes relatively high and the fluorescent lamp is lightened in the optimal state.

The amalgam may take any shape, such as pellet, cylinder, plate, or the like. The amalgam is stored in a fine tube arranged to on a stem sealed to the end of the bulb or in side the bulb 2. The amalgam is fixed to or stored in one of the positions mentioned above by means of fusion, mechanical holding or the like. Furthermore, the amalgam may be stored in the bulb to be movable therein.

At the time of lighting the fluorescent lamp 1, the temperature of the bulb 2 rises to around 80° C. In this embodiment, however, bismuth (Bi)—tin (Sn)—lead (Pb) amalgam is stored in the fine tube 2*f*, so that the vapor pressure in the bulb is controlled to a proper value based on the pressure characteristics of the mercury vapor of the amalgam, and accordingly, the lamp can be lightened with high efficiency.

Furthermore, although in the present embodiment, the glass bulb 2 is formed by partially bending the single straight-tube-shaped bulb 2*a*, in an alternation, it may be possible to connect the ends of two bulbs bent into L-shapes so as to form a single bent portion and form the glass bulb 2.

The glass bulb 2 is formed of a soft glass such as soda-lime glass, lead glass or the like, but hard glass such as borosilicate glass or quartz glass may be used as well. In addition, there may be used a glass which contains essentially no lead component with inclusion of sodium oxide of 1.0 percent by mass or less and at a softening temperature of 720° C. or lower. The disclosure of "contains essentially no lead component" means that it is permissible to include a trace as an impurity preferably of 0.1 percent by mass or less. Of course, it is most preferred that the glass does not contain no lead component. The case of including sodium oxide of 0.1 mass % or less includes a case of no sodium oxide. Also, the reason that the inclusion of sodium oxide has been stipulated to 0.1 mass % or less is that deposition of the sodium component on the inner surface of the glass bulb 2 affects the light output of the fluorescent lamp 1 if the inclusion thereof exceeds the above value. In the glass containing substantially no lead, in which the glass has inclusion of sodium oxide of 1.0 mass % and a softening temperature of 720° C. or lower, the amounts of $K_2O$ and $Li_2O$, and the amounts of CaO, MgO, BaO and SrO can be adjusted in contents. Herein, the softening temperature is a temperature wherein the viscosity $\eta$ of glass=$10^{7.65}$ dPa·s.

In the event that the amount of sodium oxide in the glass bulb 2 exceeds 0.1 mass %, a great amount of sodium is deposited on the inner surface of the glass bulb 2 during the lighting of the lamp, as an alkali component. In this case of depositing of the sodium on the inner surface of the glass bulb 2, a problem that the sodium may react with the mercury vapor sealed in the glass bulb 2, the glass bulb 2 may be colored and transmissivity of visible light is reduced, or the sodium may react with the phosphor in the phosphor layer 4, deteriorating the phosphor, and reducing the output power of visible light. Particularly, since the conventional soda lime glass contains 15 to 17 mass % sodium oxide, such deterioration of the visible light output will be remarkably observed.

Accordingly, by applying the phosphor to the straight-tube-shaped bulb 2*a* formed of a glass with an inclusion of sodium oxide of the amount of 0.1 mass % or less at a softening temperature of 720° C. or lower, 692° C. for example, and then forming the bent portions later, the amount of sodium to be deposited on the inner surface of the bulb could be drastically reduced, and in addition, the deterioration of visible light output due to the sodium reaction could be also suppressed. Furthermore, since the softening temperature is 720° C. or lower, the heating temperature at the time of forming the bent portions can be kept low, and hence, thermal deterioration of the surrounding phosphor could be reduced with increased light output performance.

The composition of the glass bulb according to the present embodiment is as follows, and the softening temperature is 692° C.

$SiO_2$: 65.0 mass %, $Al_2O_3$: 4.0 mass %, $Na_2O$: 0.05 mass %, $K_2O$: 11.0 mass %, $Li_2O_3$: 2.8 mass %, CaO: 2.0 mass %, MgO: 1.4 mass %, SrO: 5.0 mass %, BaO: 8.5 mass %, $SO_3$: 0.15 mass %, $B_2O_3$: 0 mass %, $Sb_2O_3$: 0 mass %, $Fe_2O_3$: 0.03 mass %, others: 0.17 mass %.

Hereunder, a second embodiment of the present invention will be described. In this second embodiment, the metal oxide constituting the protective layer 3 has fine particles of γ (gamma) alumina with an average grain diameter of approximately 5.0 to 50 nm, the surface area is 80 $m^2/g$ or more, and the amount of fine particles applied per surface area in the bulb is 0.01 to 0.1 $mg/cm^2$.

In the case of the second embodiment, even if the amount of protective layer 3 applied is reduced and the film thickness thereof is also reduced, the straight tube portions 2*b* are essentially not stretched, and thermal deterioration of the phosphor layer 4 of the straight tube portions 2*b* in the bent portion forming step is small. Moreover, since the thickness of the protective layer 3 is small, the functions of the protective layer 3 can be sufficiently exhibited while suppressing the causing of the cracking at the bent portions 2*c*. Furthermore, the specific surface of the fine particles is 80 $m^2/g$ or more, so the protective layer 3 is of an extremely compact structure, so alkali components deposited from the bulb 2 and mercury and the like are blocked by the protective layer 3, thereby allowing deterioration of the phosphor layer 4 over time and coloring of the bulb 2 to be suppressed effectively.

Figure 3:
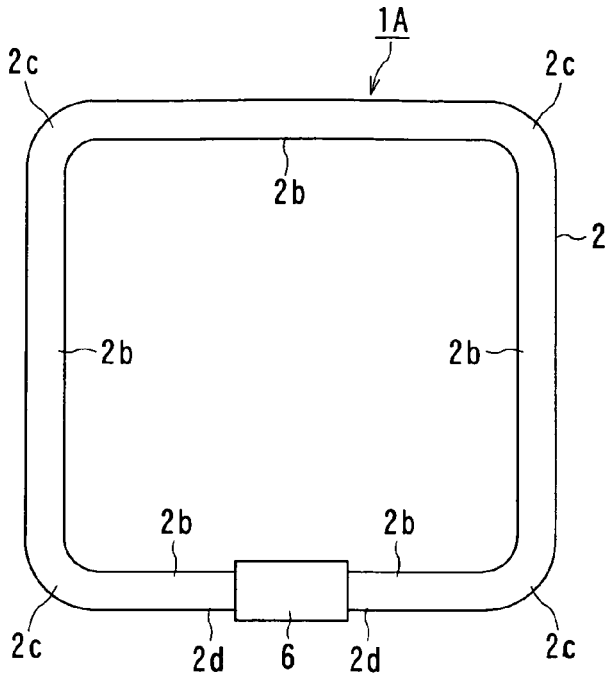
FIG. 3 is a front view of a fluorescent lamp according to a third embodiment of the present invention.

FIG. 3 is a front view illustrating a fluorescent lamp 1A of the third embodiment of the present invention. The present embodiment is the same as with the first embodiment except that the quadrate glass bulb 2 is composed of five straight tube portions 2*b* and four bent portions 2*c* formed in the diagonal directions thereof, and the base 6 positioned at the approximate central portion of one side of the bulb 2.

Figure 4:
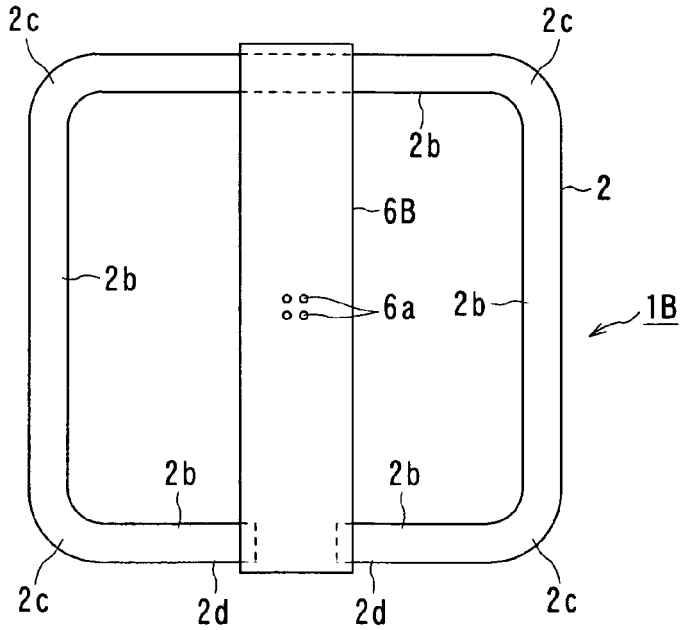
FIG. 4 is a front view of a fluorescent lamp according to a fourth embodiment of the present invention.

FIG. 4 is a front view illustrating a fluorescent lamp 1B of the fourth embodiment of the present invention. The present embodiment has a base 6B provided so as to bridge the end portions 2*d* and 2*d* of the glass bulb 2 and the straight tube portion 2*b* on the opposing side. The base pins 6*a* serving as power-supplying portions is provided at the center position of the rectangular shape of the bulb 2. Furthermore, a lamp holding mechanism to be mounted to a lamp holder of a lighting apparatus, not shown, side is provided near the power supplying member such that electrical connection is established at the same time of mounting the lamp to the lighting apparatus. By forming the base 6B in this way so as to bridge the two opposing sides of the square shape, the bulb 2 can be more stably supported and the attaching strength can be improved as well as improvement in the strength of the bulb 2 itself. In addition, by arranging the power supplying member to the approximate center of the square shape, the bulb 2 can be improved in the balance of the lamp at the time of mounting thereof, thereby facilitating replacement working thereof.

Figure 5:
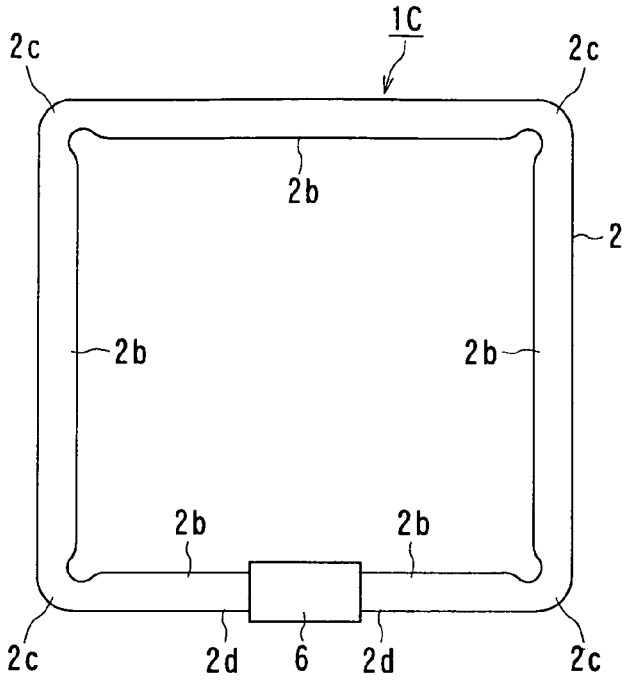
FIG. 5 is a front view of a fluorescent lamp according to a fifth embodiment of the present invention.
Figure 6:
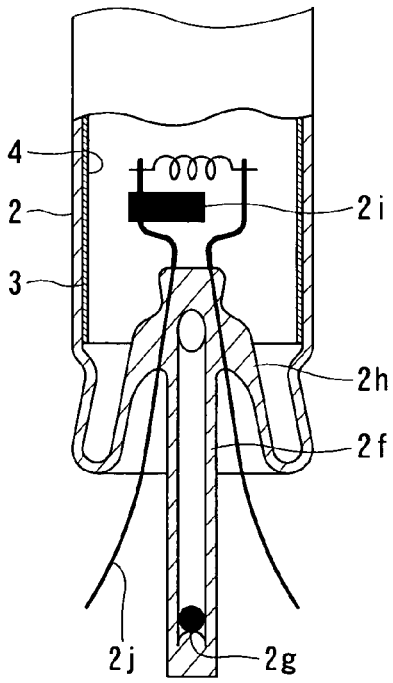
FIG. 6 is a front view, partially in section, illustrating the principal components of the fifth embodiment.
Figure 7:
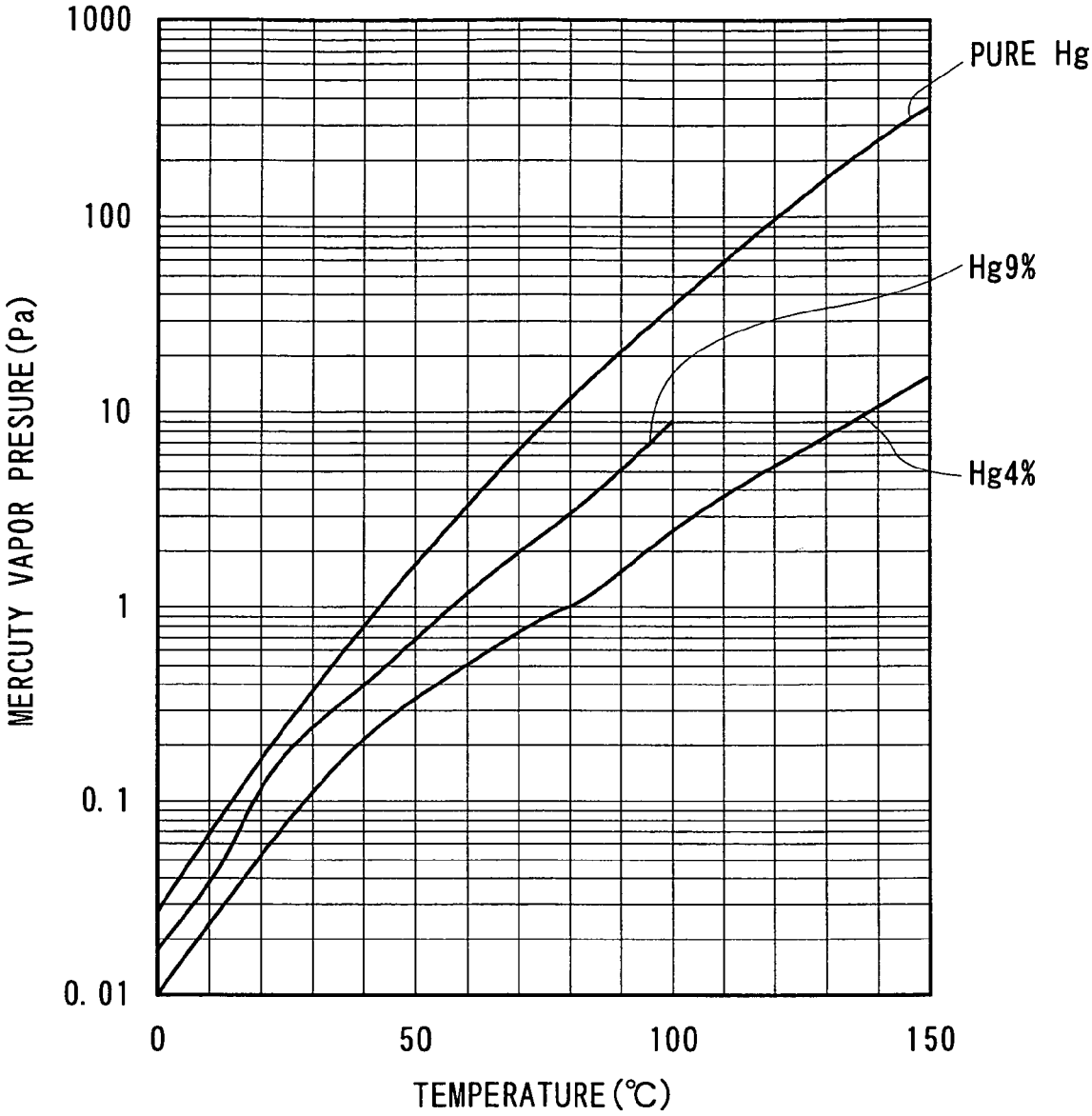
FIG. 7 is a graph showing mercury vapor pressure characteristics of main amalgam in the fifth embodiment together with those of a comparative example.

FIG. 5 through FIG. 7 illustrate a fluorescent lamp 1C which is a fifth embodiment of the present invention, in which FIG. 5 is a front view, FIG. 6 is a front view, partially in section, illustrating an arrangement of an essential portion, and FIG. 7 is a graph representing the mercury vapor characteristics of the main amalgam together with comparative examples thereof.

The present embodiment differs from the above described embodiments in that the inner diameter of the bent portion 2*c* of the glass bulb 2 is set to a predetermined dimension, that the amalgam 2*g* having predetermined characteristics of the mercury vapor is used, and that the length of the exhausting fine tube is set within a predetermined range.

That is, the inner diameter of the bent portion 2*c* of the glass bulb 2 is set to be within the range of 0.6 to 1.0 of the inner diameter of the straight tube portions 2*b*, i.e., 0.86 times in the drawing, by shaping the bent portion by using a mold at the time of thermally softening and bending the preordination portions for the bent portions 2*c* of the glass bulb 2. Furthermore, the protrusion length of the exhausting fin tube 2*f* extending externally from a stem 2*h* at one end of the glass bulb 2 is 10 mm or longer, with a coldest portion formed at the tip thereof. Further, a protective layer existing between the glass bulb 2 and the phosphor layer 3 is not shown in the drawing.

The inner diameter of the bent portion 2*c* is measured at the cross-section of the bent portion 2*c*. If the cross-sectional shape of the bent portion 2*c* is a non-circle, the inner diameter is determined at a portion having the minimum tube diameter. In a case of the inner diameter of the bent portion 2*c* being less than 0.6 of that of the straight tube portion, the temperature of the bent portion 2*c* rises. However, this is not desirable because the arc is squeezed at the bent portion 2*c*, resulting in the rising of the lamp voltage, and hence, the lamp power input becomes excessive and injection of mercury to the phosphor layer 4 increases, which finally leads to earlier deterioration of the phosphor layer. Furthermore, if the inner diameter of the bent portion 2*c* exceeds 1.0 times that of the straight tube portion, since the temperature of the bent portion 2*c* drops and the coldest portion is readily formed thereat, thus being not advantageous and desirable. On the other hand, by setting the inner diameter of the bent portion 2*c* of the bulb to be within the range of 0.6 to 1.0 times the inner diameter of the straight bulb portion 2*b*, the temperature of the bent portion 2*c* becomes substantially the same as the temperature of the straight tube portion 2*b*.

As shown in FIG. 6, the amalgam is formed of a main amalgam 2*g* and an auxiliary amalgam 2*i*. The main amalgam 2*g* contains, in terms of mass ratio, 40 to 50% Bi, 15 to 35% Pb, 15 to 40% Sn, and 6% or more Hg, and mercury vapor is introduced into the interior of the glass bulb 2 to be sealed and detained in the exhausting fine tube 2*f*. In addition, the main amalgam 2*g* includes 9 mass % of mercury in the above component range and has the pressure characteristics of the mercury vapor shown in FIG. 7.

The auxiliary amalgam 2*i* is composed of In or Au deposited on a stainless steel substrate and is disposed by welding the substrate at a position near the electrode 5 of a power source side lead-in wire 2*j* at the time of lighting.

Figure 8:
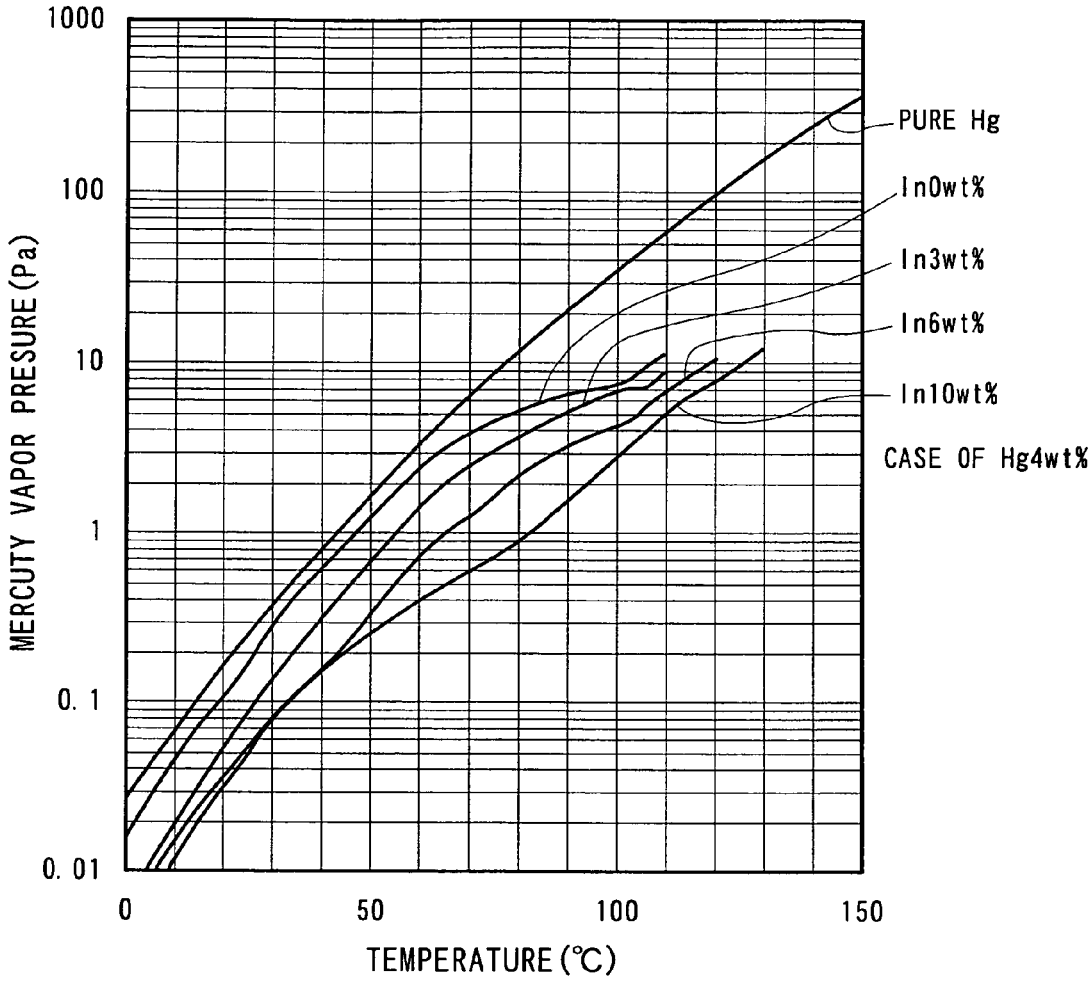
FIG. 8 is a graph showing the mercury vapor characteristics of main amalgam in a sixth embodiment of the present invention together with those of a comparative example.

FIG. 8 is a graph illustrating the mercury vapor characteristics of the main amalgam in a fluorescent lamp according to the sixth embodiment of the present invention together with a comparative example.

In this embodiment, the composition of the main amalgam 2*g* differs from that in the fifth embodiment, and that is, the main amalgam 2*g* contains, in terms of mass ratio, 50 to 60% Bi, 45 to 50% Pb, 0 to 3% In, and 3 to 5% Hg. Furthermore, the main amalgam 2*g* exhibits changes in the pressure characteristics of the mercury vapor in accordance with the inclusion amount of In such as shown in the drawing.

It may be possible for the main amalgam 2*g* to be fused and fixed in a ring-shaped molding portion to be formed to the end surface of the bulb by heating the end portion of the bulb and or forming a neck portion on the way of the fine tube so as not to fall down the main amalgam 2*g* in the fine tube.

Furthermore, it is desirable that the main amalgam 2*g* has the mercury vapor pressure within the range of approximately 0.13 to 1.1 Pa when the temperature is 50° C. at the portion of the bulb 2 close thereto or at the outer surface of the fine tube, and preferably, within the range of approximately 1.2 to 1.3 Pa at the temperature of 100° C. at these portions.

Figure 9:
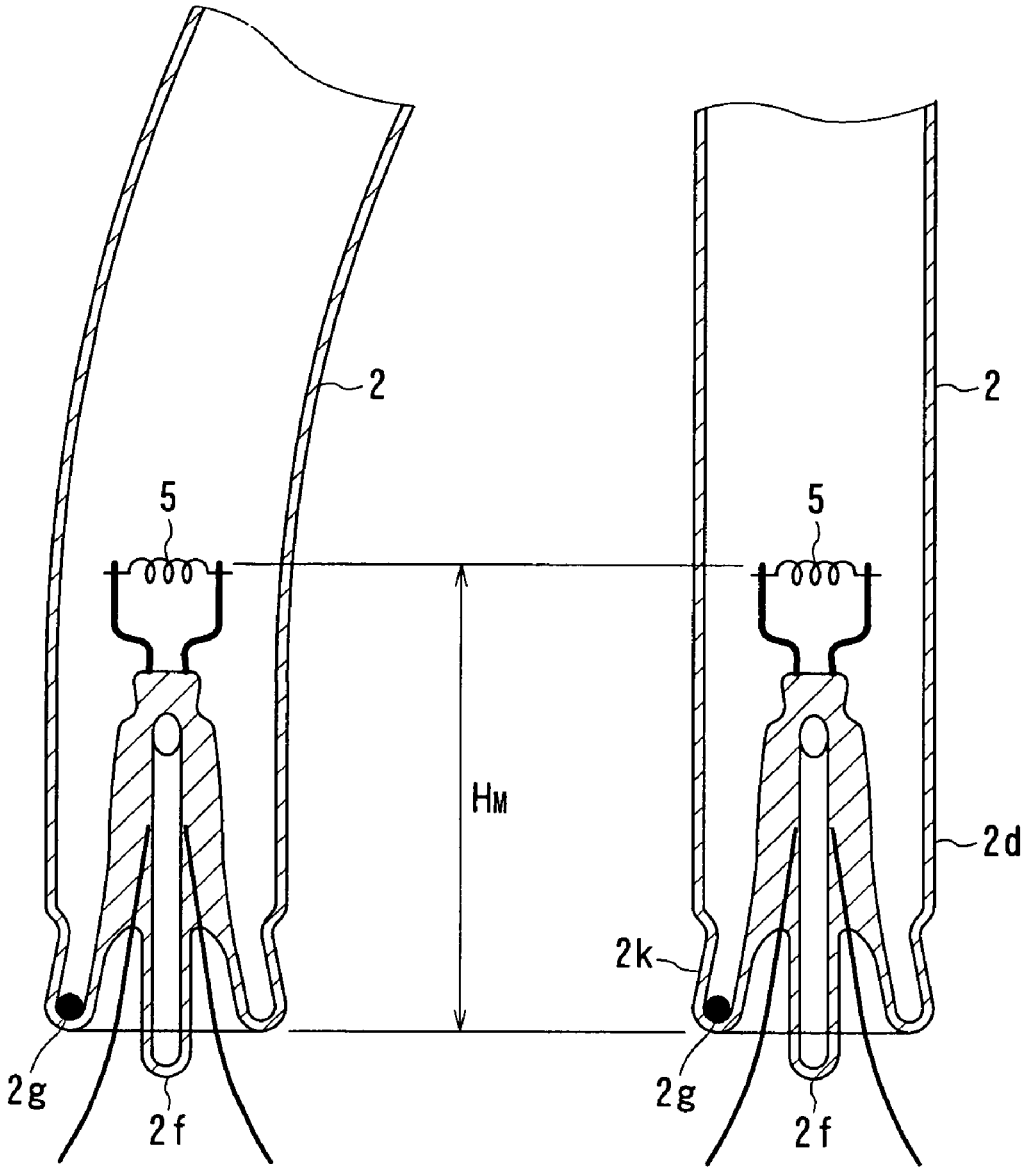
FIG. 9 is a front view illustrating a positional relation between a glass bulb and electrodes in a fluorescent lamp according to a seventh embodiment of the present invention together with those of a conventional ring-shaped fluorescent lamp.

FIG. 9 is a front view showing an essential portion of the fluorescent lamp of this embodiment and illustrating the positional relation between the glass bulb and electrodes of the a fluorescent lamp of this seventh embodiment together with those of a conventional ring-shaped fluorescent lamp (left side view in FIG. 9) for comparison.

In this embodiment, instead of the mercury vapor pressure controlling amalgam, the electrode 5, having its height $H_M$, disposed on the tube end portion side of the exhaust side, which is set to be within the range of 30 to 50 mm, 40 mm for example, so that the most cooled portion is formed at the tube edge portion. Further, in the present invention, the electrode 5 is positioned at a portion facing the straight tube portion 2*b* of the glass bulb 2, so that the distance between the inner surface of the glass bulb and the electrode 5 becomes greater than that of the ring-shaped fluorescent lamp, and therefore, as can be seen from FIG. 9, the electrode 5 does not easily come into contact with the phosphor layer of the tube wall. Further, in FIG. 9, reference numeral 2*g* denotes zinc amalgam for sealing in a predetermined amount of mercury, with the phosphor layer being omitted from the drawing for the sake of convenience in description.

Moreover, since the most cooled portion of the glass bulb 2 has the large height, the coldest portion of the glass bulb 2 is formed at a ring-shaped mold portion 2*k* (near the amalgam 2*g*) near the sealing portion at the tube end side of the exhaust side, or at the front end portion of the excavating fine tube 2*f*.

Figure 10:
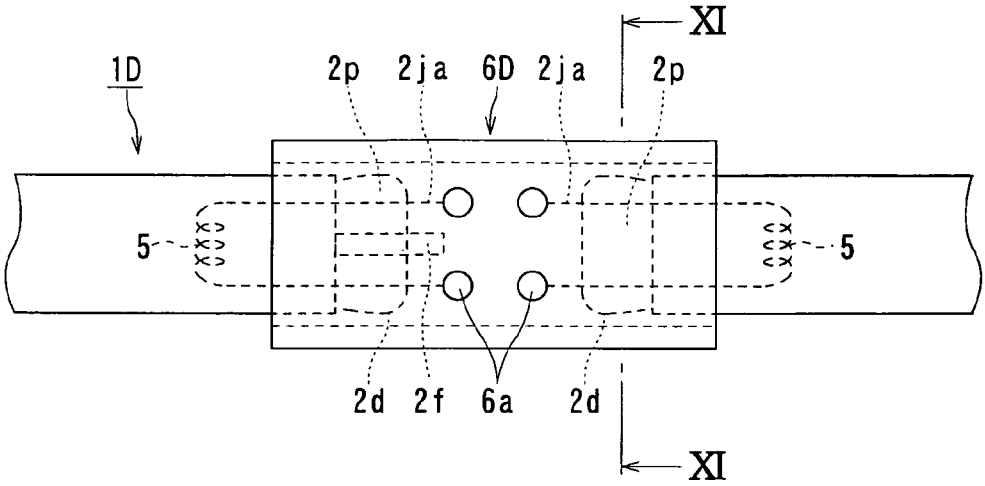
FIG. 10 is a view showing an essential portion of a fluorescent lamp, in an enlarged scale, according to an eighth embodiment of the present invention.
Figure 11:
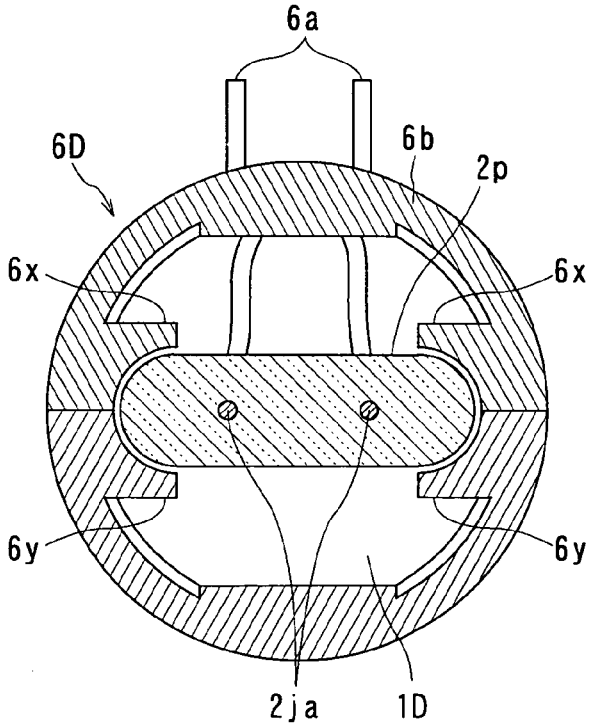
FIG. 11 is an end view at a cutaway portion taken along the line XI-XI in FIG. 10.

FIG. 10 is an enlarged front view of the base 6 of a fluorescent lamp 1D together with its surroundings of the eighth embodiment of the present invention, and FIG. 11 is an end taken along the line XI-XI in FIG. 10.

This embodiment differs from the embodiments mentioned hereinabove in the provision of a turning motion restricting member for preventing a base 6D, formed of plastic material, for example, to be fitted externally to both axial-direction end portions 2*d* and 2*d* of the glass bulb 2 in which the pair of electrodes 5 and 5 are sealed, from turning about the tube axis with respect both the end portions 2*d* and 2*d* of the glass bulb 2.

That is, in the fluorescent lamp 1D shown in FIG. 10, the pair of electrodes 5 and 5 are sealed in the both axial end portions 2*d* and 2*d* of the glass bulb 2, a pair of lead-in wires 2*j* and 2*j* connected to both the ends of the electrodes 5 are extended from both the end portions 2*d* and 2*d* of the glass bulb 2 in an airtight manner, and the front portions of the outer leads 2*ja* and 2*ja*, as the external ends thereof, are fixed to the inner front portions of base pins 6*a* of the base 6D.

The glass bulb 2 has both the end portions 2*d* and 2*d*, from which the pair of outer leads 2*ja* and 2*ja* externally extend in an airtight manner, pressed flat into pinch seal portions 2*p*, thereby sealing the lead-in wire 2*j* in an airtight manner, and the pinch seal portions 2*p* are shaped by molding into flattened shapes.

As shown in FIG. 11, the base 6D has engaging protrusions 6*x* and 6*y* of the plastic base main unit 6*b* in form of a cylindrical member which is dividable into two parts, top and bottom, so as to be fitted from the external side to both side ends of the pinch seal portions 2*p*.

According to this arrangement, the base 6D can be prevented from turning about the tube axis with respect to the glass bulb 2, thereby preventing the outer leads 2*ja* from breaking, the pair of outer leads 2*ja* and 2*ja* from contacting to each other, and a lighting circuit, not shown, from damaging due to short-circuiting and both the end portions 2*d* and 2*d* of the glass bulb.

That is, in the case where the base main unit turns with to the tube axis as like as the bases of conventional ring-shaped fluorescent lamps, since both the ends of the outer leads 2*ja* are fixed to each of the pinch seal portions 2*p* and the inner front end portion of the pin 6*a* of the base 6D, pulling or twisting of the outer leads 2*ja* by the turning of the base 6 may be caused, resulting in breakage thereof, damage to the pinch seal portions 2*p*. Conversely, the adjacent outer leads 2*ja* may come into contact one another and cause short-circuiting, thus damaging the lighting circuit.

However, according to the fluorescent lamp 1D of the present embodiment, the base main unit 6*b* can hardly be moved with respect to the glass bulb 2 due to the provision of the turn restricting member, so that the problems encountered in the prior art mentioned above to the base can be effectively solved.

Figure 12:
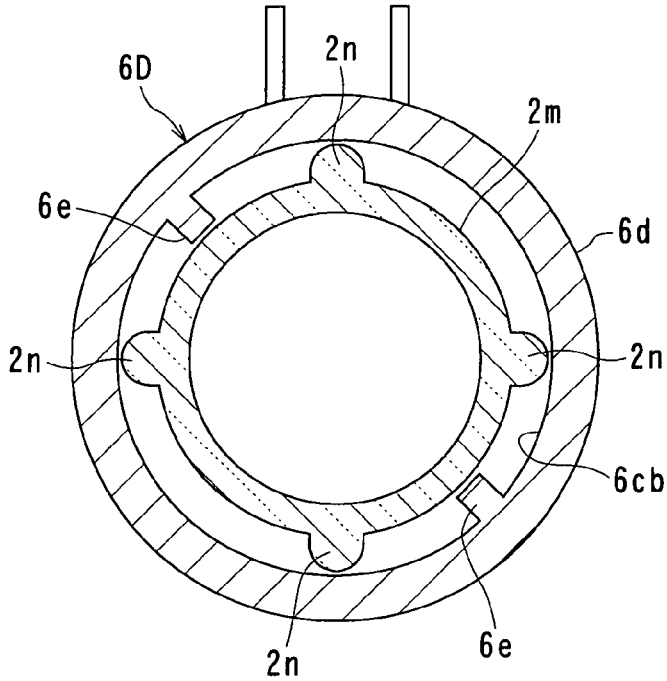
FIG. 12 is also an end view illustrating a modification of the eighth embodiment.

FIG. 12 is a cross-sectional view of another modification of the turn restricting member of the base 6D. The turn restricting member permits the turning of the base 6D around the tube axis by 45° in the forward and reverse direction, with a plurality of outward-facing retaining protrusions 2*m* being protruded by means of glass frits or like on the outer peripheral surfaces of both the end portions 2*d*, approximately circular axial cross-sectional shape, with the center angles thereof being approximately at right angles. In such modified example, it is not necessary to form the pinch seal portions 2*p* such as shown in FIG. 10 and can be utilized for the bulb end portions 2*d* using a flare stem such as illustrated to the right side in FIG. 9.

On the other hand, on the inner peripheral surface of a fitting hole 6*cb* of the base main body 6*b*, a pair of inward-facing retaining protrusions 6*e* and 6*e* protruding toward the center side of the fitting hole at an intermediate portion of the circumference between the pair of protrusions 2*m* adjacent in the circumferential direction of both edge portions 2*m* of the glass bulb are provided integrally in a standing manner at an opposing position in the diameter direction.

Accordingly, the base 6D turns 45° in the clockwise direction (forward direction) with respect to the glass bulb 2, and on the other hand, also turns 45° in the counter-clockwise direction (reverse direction). However, in this case, it is necessary to provide the outer leads 2*ja* and 2*ja* with a sufficient length so that the outer leads 2*ja* and 2*ja* will not be pulled and broken or the pinch seal portions 2*p* are not damaged at an occurrence of such turning, and it is also necessary to provide an element or like for preventing electrical connection between the pair of outer leads 2*ja* and 2*ja*.

According to this base 6D, the base 6D can rotate 45° in each of the forward and reverse directions with respect to the glass bulb 2 about the tube axis, so that a range capable of mounting the base to a power supplying socket fixed to the lighting apparatus body can be widened by rotating the base 6D after the fixing of the glass bulb 2 a lamp holder of the lighting apparatus body. Further, it is to be noted that it is not necessary to limit the turning angle of the base 6D to 45° in each of the forward and reverse directions and can be suitably selected as occasion demands by appropriately changing the positions of the outward-facing retaining protrusions 2*m* and the inward-facing retaining protrusions 6*e*.

Figure 13:
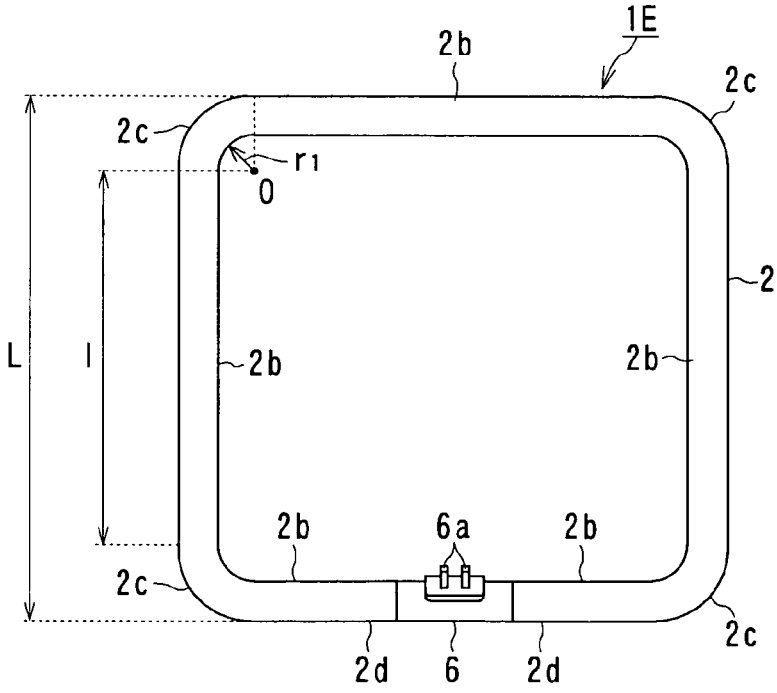
FIG. 13 is a front view of a fluorescent lamp according to a ninth embodiment of the present invention.
Figure 14:
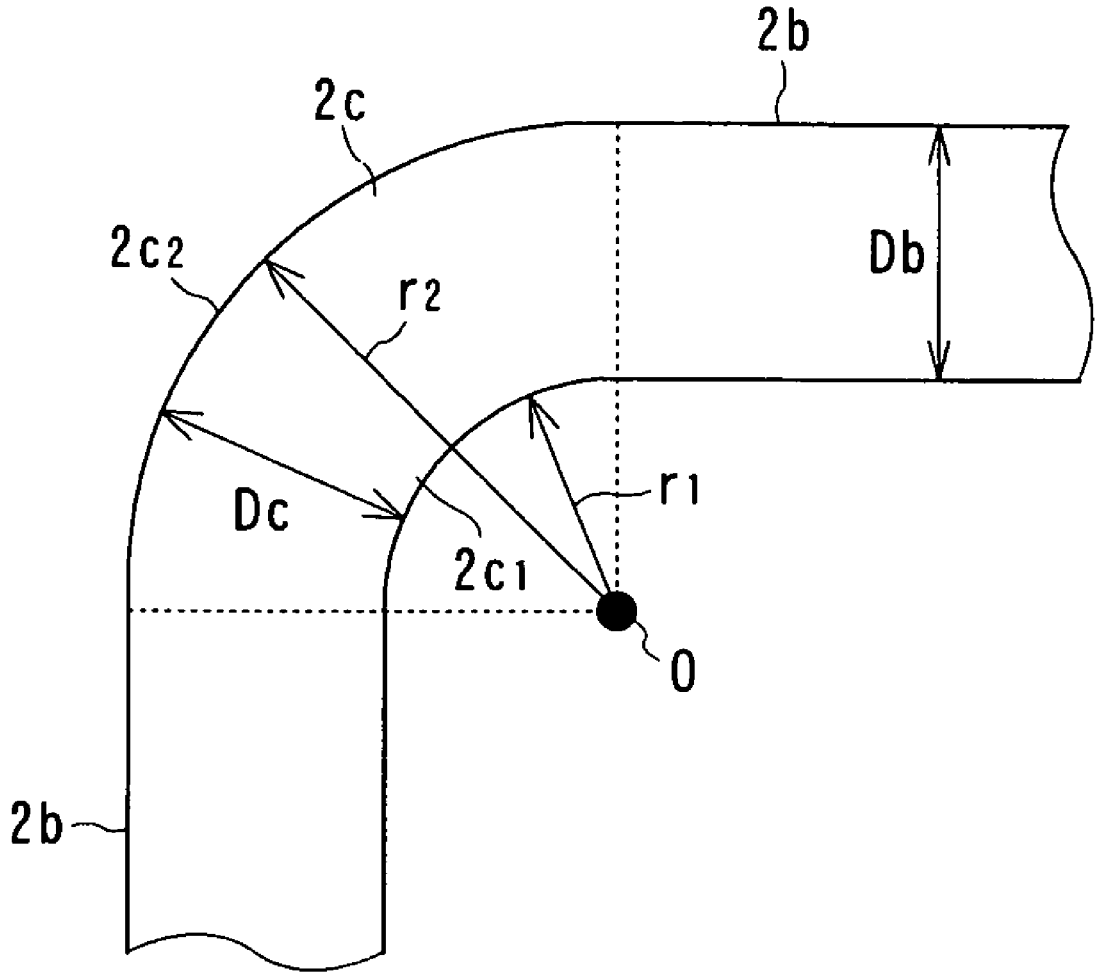
FIG. 14 is an enlarged view of a bent portion shown in FIG. 13.

FIG. 13 is a front view of a fluorescent lamp 1E according to the ninth embodiment of the present invention, and FIG. 14 is an enlarged view of a bent portion thereof.

In this embodiment, in a case where the radius of curvature of the bent portion 2*c* of the glass bulb 2 is too small, the outer side of the bent portion 2*c* will stretch too mach and become too thin and accordingly breaks readily. Thus, the embodiment is characterized by the feature in which the radius of curvature of the bent portion 2*c* and the thickness of the wall are stipulated to predetermined values, thereby improving the strength of the fluorescent lamp 1E.

As shown in FIG. 14, the bent portion 2*c* is formed such that the center O of curvature radius r1 of the inner side surface 2*c*1 and the center O of curvature radius r2 of the outer side surface 2*c*2 take substantially the same position. The inner side surface 2*c*1 of the bent portion 2*c* means the surface facing the center portion of an imaginary ring-shaped pane formed by the glass bulb 2, and the outer side surface 2*c*2 of the bent portion 2*c* means the surface position opposite by 180° from the inner side surface 2*c*1 at the bent portion 2*c* with the tube axis being the center therebetween (i.e., a surface facing the direction radially extending in parallel from the central portion of a ring-shaped plane formed by the glass bulb 2 along this plane).

The curvature radii r1 and r2 are defined by curves formed at a position at which the inner and outer side surfaces 2*c*1 and 2*c*2 and an imaginary ring-shaped plane formed by the glass bulb intersect, and more conveniently, may be defined by the radius of curvature of the inner and outer outlines formed at the bent portion 2*c* when observing the glass bulb from a direction perpendicular to the imaginary ring-shaped plane formed by the glass bulb 2. The optimal range for the curvature radius r1 is 10 to 30 mm, and the optimal range for the curvature radius r2 is 25 to 55 mm. On the other hand, in this embodiment, the curvature radius r1 is 15 mm and the curvature radius r2 is 31.5 mm. Further, for the sake of increasing the strength of the bent portion 2*c*, the wall thickness t2 at the outer side face 2*c*2 of the bent portion 2*c* and the wall thickness t1 at the inner side face 2*c*1 are made to be 0.5 mm or thicker through the bending working. In addition, in the case where the bulb 2 has an entirely long length L, the stress applied to the bent portions 2*c* increases and the glass expanding ratio on the outer side of the glass will be increased, so that it is also necessary to increase the thickness at the bent portions after all so as to ensure the mechanical strength. Experimentation performed based on the above matters showed that the strength of the bent portions 2*c* could be ensured by adjusting the wall thickness t0 of the straight tube portions so as to satisfy the equation of $0.36\ (L/r1) \leqq t0 \leqq 0.2\ (L/r1)$.

Further, the tube diameter Dc of the bent portion 2*c* is formed to be approximately the same as the tube diameter Db of the adjacent straight tube portion 2*b*. By thus forming the bent portion 2*c*, a visual recognition that the external view of the bent portion 2*c* of the ring-shaped bulb 2 is configured with a continuous curve from the straight tube portion 2*b* is given, so that the visual appearance of the light-emitting tube 2 can be improved. Furthermore, since low-temperature portions at the time of lighting are not partially formed, it is hard that the coldest portion is readily formed and that black spots or stains due to aggregation are also readily formed at the bent portion 2*c*.

Further, the diameter Dc of the bent portion 2*c* and the tube diameter Db of the straight tube portion 2*b* are both 16.5 mm in the lamp of this embodiment. The length l of the straight tube portion 2*b* is 237 mm.

According to this embodiment, the thickness of the wall at the bent portions 2*c* and the straight tube portions 2*b* are thus prescribed to the predetermined values, so that the shock withstanding strength of a level assumed to be encountered in normal use of the fluorescent lamp 1 can be ensured.

Figure 15A:
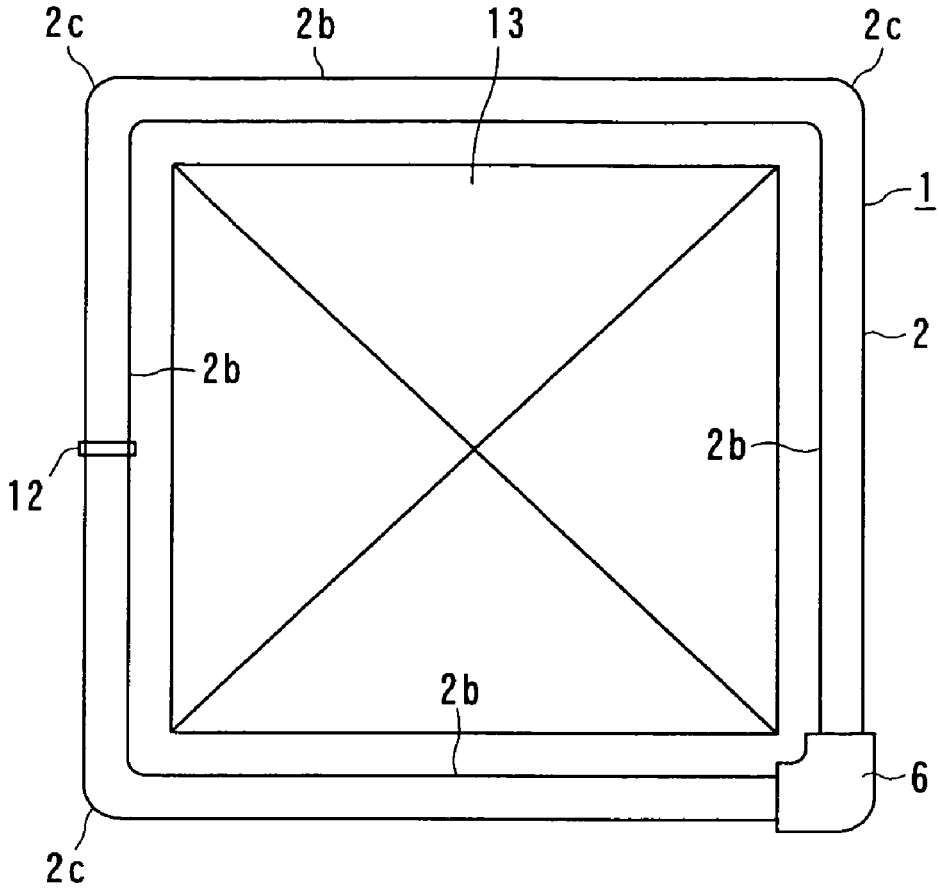
FIG. 15(*a*) is a front view illustrating a lighting apparatus of a tenth embodiment of the present invention, and FIG. (*b*) is a side view thereof.
Figure 15B:
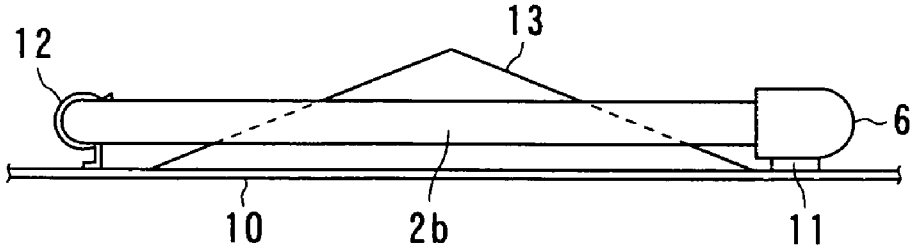

FIG. 15 illustrates a light apparatus according to the tenth embodiment of the present invention, wherein FIG. 15(*a*) is a front view and FIG. 15(*b*) is a side view thereof.

This embodiment relates to a lighting apparatus using one of the fluorescent lamps 1 and 1A through 1E (for example, fluorescent lamp 1) according to the above-described first to ninth embodiments. The fluorescent lamp 1 is connected to a socket 11 of the apparatus (main) body 10 and is mounted to a lamp holder 12 formed of springs, having a shape following that of the bulb side. A pyramid-shaped white reflecting member 13 having a quadrangular pyramid shape is disposed at the center portion of the fluorescent lamp 1, attached to the apparatus body 10. The reflecting member 13 is formed to have a hollow structure and stores the lighting device therein and so on. The reflecting member 13 may be directly attached to the lamp 1 side.

Since the lighting apparatus according to the present invention has the reflecting member 13 having a quadrangular pyramid shape disposed in the center of the square fluorescent lamp 1, the high reflection efficiency in the downward direction from the device fixture can be achieved and the lighting efficiency can also be improved.

FIG. 16 and FIG. 17 illustrate an eleventh embodiment of the present invention, in which FIG. 16 is a front view of a fluorescent lamp, and FIGS. 17(*a*) and (*b*) are cross-sectional views of an essential portion thereof in an enlarged scale in a section taken along the line XVII-XVII in FIG. 16.

In the drawings, reference numeral 101A denotes a fluorescent lamp having a rectangular glass bulb 102 constituted substantially in the quadrate shape by straight portions. A discharge medium composed of noble gas and mercury are sealed in the glass bulb 102. The noble gas is argon (Ar) gas sealed in at a pressure of approximately 320 Pa.

A protective layer 103 approximately 1.0 μm thick is formed, on the inner surface of the glass bulb 102, of alumina ($Al_2O_3$) fine particles serving as metal oxide fine particles, and a phosphor layer 104 is formed, on the inner surface of this protective layer 103, of fine particles of the 3-wavelength emission phosphor. The phosphor layer 104 is formed of the 3-wavelength emission phosphor fine particles with a correlated color temperature of 5000 K, which is applied with the amount in a range of 4.0 to 6.0 mg/cm$^2$, and then formed so as to have a thickness of 20 μm by way of drying and sintering process.

The glass bulb 102 has a circular cross-sectional shape with four straight tube portions 102*b* and three bent portions 102*c* so that the four straight tube portions 102*b* are continuously arranged within the same plane so as to form the sides of the quadrate shape. In general it is preferred that the one side length l of the glass bulb 102 is 200 mm or longer, and in this embodiment, the length 1 is approximately 300 mm. Both end portions 102*d* of the glass bulb 102 are disposed in close proximity, and filament electrodes 105, 105 formed of triple coils coated with an emitter substance are sealed at both end portions 102*d*, respectively.

It is generally preferred that the inner tube diameter of the straight tube portion 102*b* is 12 to 20 mm, the thickens of the wall of the tube is 0.8 to 1.5 mm, and in this embodiment, the inner tube diameter is approximately 16 mm, and the thickens of the wall of the tube is approximately 1.2 mm. The interiors of the respective straight tube portions 102*b* are communicated with each other through the bent portions 102*c* in a manner that a single discharge path is formed so as to surround the center of the general quadrate shape formed by the straight tube portions 102*b* between the pair of electrodes 105 and 105.

A base 106 is mounted on both end portions 102*d* and 102*d* of the glass bulb 102 so as to straddle both the end portions 102*d* and 102*d*. The base 106 has a power supply member 106*a* formed from four pins electrically connected to the pair of electrodes 105 and 105. The fluorescent lamp 101 has three bent portions 102*c* formed at portions on the diagonal line of the quadrate shape, and the base 106 is disposed at the other remaining one portion on the diagonal line.

FIG. 17 is a cross-sectional view showing the bent portion 102*c*, in which the cross-sectional shape of FIG. 17(*a*) has substantially isosceles triangle shape having an apex 102*c*1 protruding outwards from a plane formed by the four straight tube portions 102*b*, and the cross-sectional shape of FIG. 17(*b*) has the substantially the isosceles triangle shape having a base 102*c*1' protruding outwards. The inner tube diameter (maximal diameter) a of the bent portion 102*c* corresponds the height of the isosceles triangle having the apex 102*c*1 of the bent portion 102*c*. The inner tube diameter D1 is formed to be 1.2 to 2.0 times the inner tube diameter of the straight tube portion 102*b*. In this embodiment, the inner tube diameter of the straight tube portion 2*b* is approximately 13.6 mm, and the inner tube diameter D1 at the bent portion 102*c* is approximately 27.2 mm, which is substantially twice the inner tube diameter of the straight tube portion 102*c*. Further, it is to be noted that the minimum width b of the inner tube diameter is substantially the same as the length in the base direction of the isosceles triangle, i.e., the cross-sectional shape of the bent portion 102*c*, which is 13.6 mm being the same as the inner tube diameter of the straight tube portion 102*b*.

The wall thickness of the bent portion 102*c* is preferably the same as the wall thickness of the straight tube portion 102*b* or greater, in order to maintain the mechanical strength of the bent portions 102*c*. Particularly, the wall thickness of the apex 102*c*1 in the case of FIG. 17(*a*) easily becomes thin because the cross-sectional shape of the bent portions 102*c* is approximately isosceles triangle shape, and accordingly, the thickness is preferably 0.8 to 1.2 times the thickness of the straight tube portion 102*b*.

With the bent portion 102*c* in which the base 102*c*1' protrudes outward as shown in FIG. 17(*b*), since the discharge passage is formed inside, the non-discharge region can be formed large, thus providing high cooling effect and optimal coldest portion.

The operations of this embodiment will be described hereunder. The fluorescent lamp 101A (1), to which high-frequency electric power is inputted through the base 106, is lightened through the discharging of the low-pressure mercury vapor in the bulb 102. The fluorescent lamp 101A is lit (with the lamp input power of 20 W or more, lamp current of 200 mA or more, tube wall load of 0.05 W/cm$^2$ or higher, and the lamp efficiency of 50 lm/W or more. In addition, the lamp current density, which is the lamp current per cross-sectional area of the straight tube portion 102*b*, is 75 mA/cm$^2$ or higher. In the case of the present embodiment, the lamp input power is 50 W, lamp current is 380 mA, and lamp efficiency is 90 lm/W.

At the time of lighting the fluorescent lamp 101A, the coldest portion is formed to at least one bent portion 102*c*. In this embodiment, although the outer surface temperature of the straight tube portion 102*b* is 80° C. when lit in a state that the glass bulb 102 is exposed to ambient temperature of 25° C., the temperature of the apex 102*c*1 of the bent portion 102*c* is 50° C., thereby confirming that a coldest portion is formed at this apex 102*c*1. The outer surface temperature of the apex 102*c*1 in the range of 40 to 65° C. is suitable for the coldest portion, and if the mercury vapor pressure within the fluorescent lamp 101A is optimal as long as the coldest portion is within the temperature range, the lamp can be lit with the high lamp efficiency.

Furthermore, although, in this embodiment, the glass bulb 102 is formed by locally bending a single straight-tube-shaped bulb 102*a*, a plurality of straight-tube-shaped bulbs may be connected at the ends to thereby form a bent portion of the glass bulb 102. For example, the plural straight-tube-shaped bulbs may be connected so as to provide joining portions by locally heating and fusing the end portions thereof and then blowing, and these joining portions are then connected and molded to form the bent portions 102*c* of the desired shape.

Figure 18:
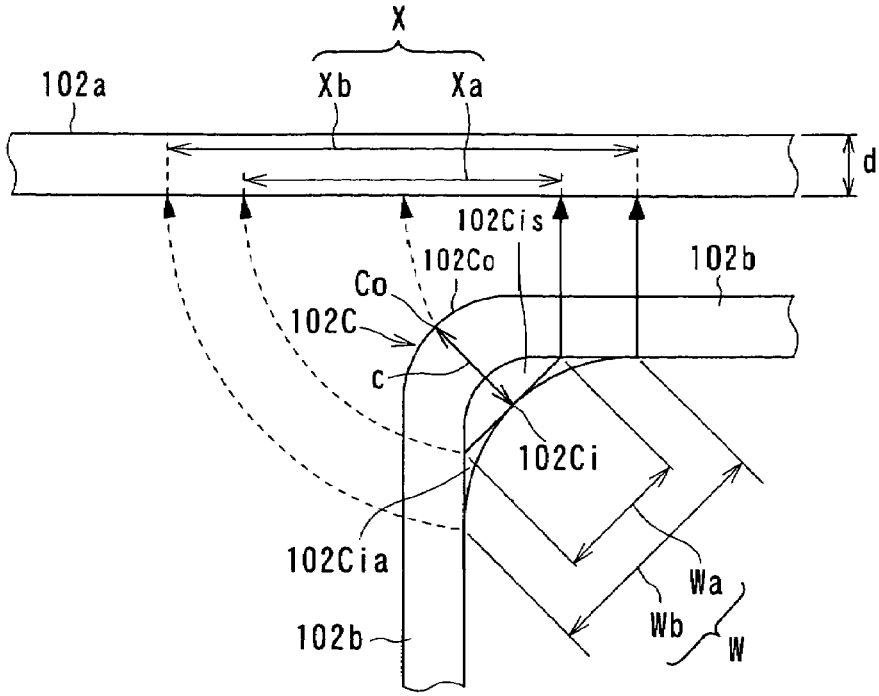
FIG. 18 is an enlarged view of an essential portion showing a mutual relation between the burning width of a bent-portion-formation preordination portion of a straight-tube-shaped glass bulb and the bending width thereof.

FIG. 18 illustrates a case of locally heating and softening the single long straight-tube-shaped bulb 102*a* and forming a plurality of bent portions 102*c* to obtain a square shape, as shown in FIG. 16, and in such case, there is shown the mutual dimensional relation between the heating width of the straight-tube-shaped glass bulb 102*a*, i.e., the burning width x, and the bending (curving) width c of the bent portion 102*c*.

As shown in FIG. 18, the bending width c is a length necessary for forming the coldest portion at the bent outside tube wall 102C0 of the bent portion 102*c*, indicating the length from the coldest point C0 formed at the bent outside tube wall 102C0 to the outer surface center of the radially-opposing bent inside tube wall 102Ci. The length of the burning width x of the straight-tube-shaped bulb 102*a* is affected by the length of the bending width c, and the width dimension W on the inner side of the bent portion (the length in the direction orthogonal to the length direction of the bending width c and parallel to the longitudinal direction of the straight-tube portion) decreases in proportional to the burning width x.

That is, in a case of locally heating and softening a single long straight-tube-shaped bulb 102*a* provided with the protective layer 103 and phosphor layer 104, which were formed preliminarily, and then bending the bulb 102*a* at a predetermined angle to obtain a square shape, the glass bulb 102*b* expands and shrinks at the bent portions 102*c*, and this expanding and shrinking causes peeling and cracking to the protective layer 103 and phosphor layer 104, causing factors of light flux deterioration at these portions, and therefore, it is desirable to make the width dimension W and the burning width x lengths as small as possible.

Further, in the case of the same lamp current, the temperature of the coldest point C0 of the bent portion 102*c* is dependent on the bending width c.

Accordingly, in order to obtain the optimal coldest point temperate at this coldest point C0, the bending width c is set to be longer than the outer tube diameter d of the straight-tube-shaped bulb 102*a*, and the bent inside tube wall 102*ci* is formed at an approximately straight (planar) wall 102*cis* connecting both edges of the inner side of the bent portion with the shortest distance on the straight line, thereby forming the burning width x at the minimal burning width xa. Although the straight wall 102*ci* is preferably a straight plane, this is not restrictive, and the wall 102*ci* may be a somewhat curved surface. Further, it is desirable that the width dimension W is defined as the width dimension of the plane 102*ci* continuously changing from the straight tube portion 102*b*.

Accordingly, the bending width c and the width dimension W of the inner side of the bent portion are obtainable from the following equation [Numerical Expression 1].

$$d<c \qquad \text{[Numerical Expression 1]}$$

$$0.5d<W<3d$$

On the other hand, in a case of forming an arc-shaped wall 102*cia* for the bent inside tube wall 102Ci, the burning width w is a longer width wa than the above minimal burning width $w_{min}$ ($w_{min}$<wa), which is undesirable.

Figure 19:
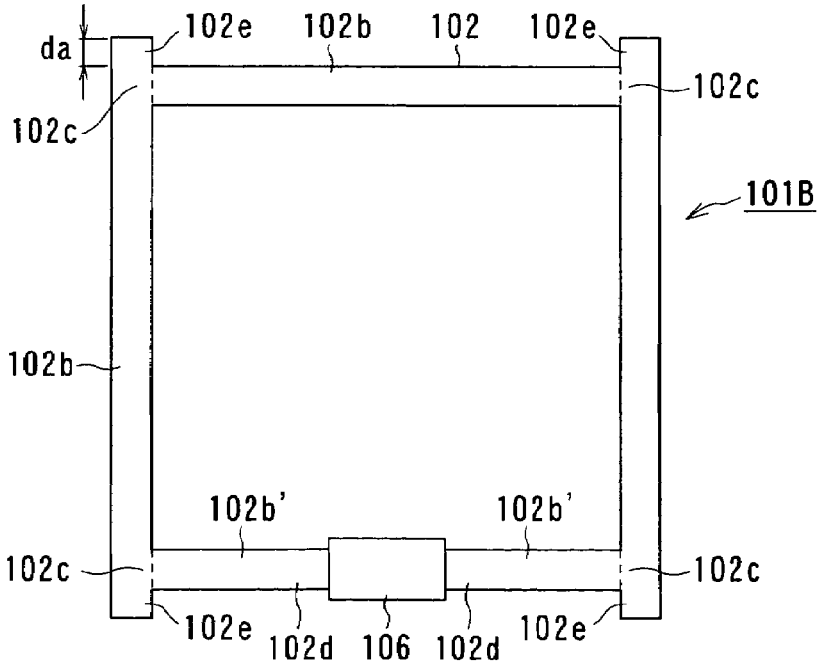
FIG. 19 is a front view of a fluorescent lamp according to a twelfth embodiment of the present invention.

FIG. 19 is a front view of a fluorescent lamp 101B according to the twelfth embodiment of the present invention. This embodiment has a characteristic feature such that the tip 102*e* of one of adjacent straight tube portions 102*b* protrudes so as to extend in the axial direction of the straight tube portion 102*b* over the joining portion so as to form a protrusion 102*e* at the bent portion 102*c* of the glass bulb 2. The protruding length da of the protrusions 102*e* is within the range of 5.0 to 20 mm, and preferably of 0.2 to 1.2 times the length of the outer tube diameter of the straight tube portion. In the case of this embodiment, the protruding length da is approximately 10 mm.

Furthermore, the four bent portions 102*c* are formed by connecting five straight-tube-shaped bulbs 2*b*. That is, one side of the quadrate shape of the bulb is formed of straight tube portions 102*b*' and 102*b*' having the length half (½) the length of the other sides, and electrodes (not shown) are sealed to the end portions 102*d* of the straight tube portions 102*b*' and 102*b*'. The base 6 is provided so as to straddle the end portions 102*d* of the straight tube portions 102*b*' and 102*b*'.

In this embodiment, since the bent portions 102*c* can be formed as tips 102*e* and it is not necessary to carry out special working, such as molding, after the connection of the straight bulb portions, the bulb 102 can be easily formed even in the case of connecting the plural straight portions 102*b* to form the bulb 102.

Figure 20:
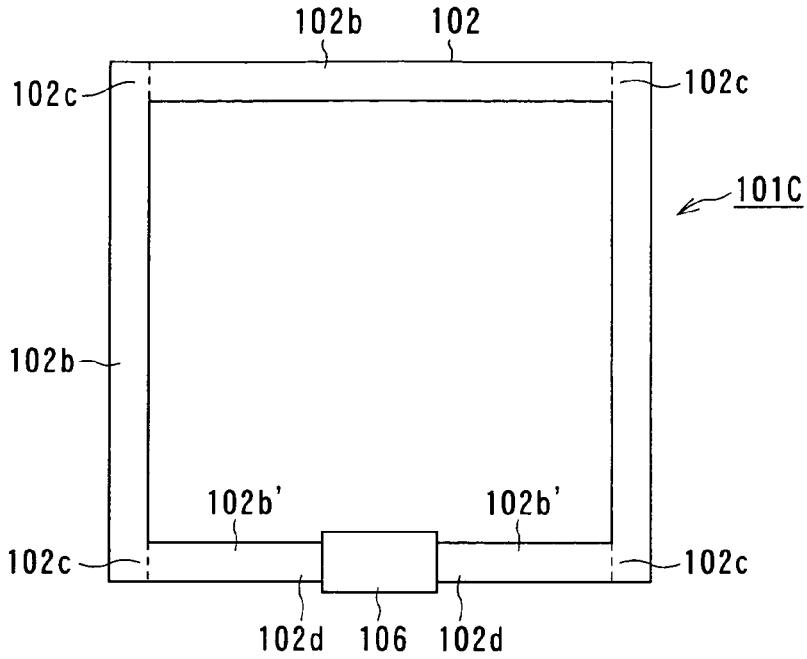
FIG. 20 is a front view of a fluorescent lamp according to a first modification of the embodiment shown in FIG. 19.

Further, in the fluorescent lamp 101*c* shown in FIG. 20, the protrusions 102*e* are not formed, but five straight tube portions 102*b* are connected and molded, subsequently, into a square shape. The fluorescent lamp according to this embodiment is one having a small diameter with a bulb tube outer diameter of 12 to 20 mm as in the twelfth embodiment. Thus, the connection of the bulb tips one another or connection of the bulb tip with the side surface can be easily done with higher mechanical strength than the connection of the pipe sides with small-diameter connecting tubes.

Figure 21:
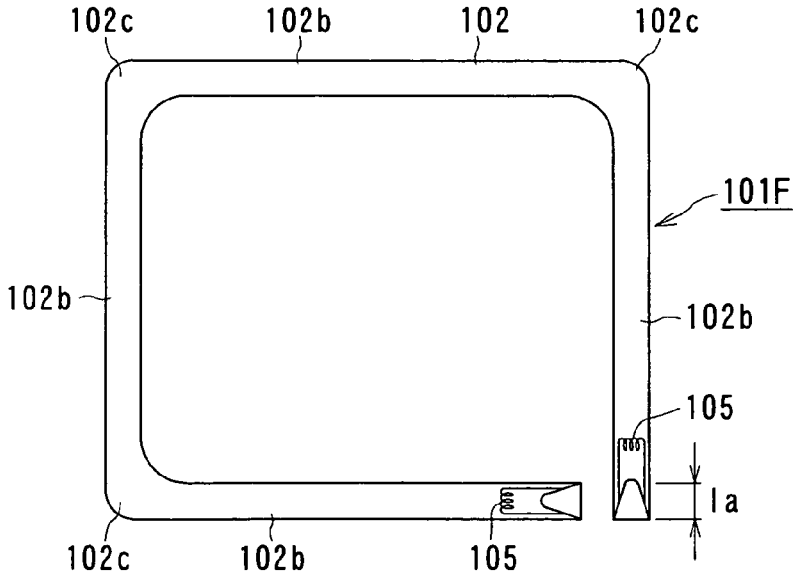
FIG. 21 is a front view of a fluorescent lamp according to a third modification of the embodiment shown in FIG. 19.

FIG. 21 is a front view of a fluorescent lamp 101F according to a first modification of the eleventh embodiment shown in FIG. 16. This fluorescent lamp 101F has characteristic feature such that one side (the right side in FIG. 21) of the outer end portion, at which one electrode 105 of the squared glass bulb 101F is sealed, extends by a length La to a horizontal extension at the outer surface (lower surface) in the drawing of the electrode end portion, at which the other one electrode 105 is sealed. Other than the above structure, this modified embodiment has substantially the same structure as that of the eleventh embodiment.

Accordingly, with this fluorescent lamp 101F, the length of discharge path can be expanded by an amount of the extension La at the end portion of the glass bulb 102, so the dark portion between electrode sealing end portions can be removed or reduced. Therefore, the visual appearance and entire light flux of the fluorescent lamp 101F can be improved.

Figure 22A:
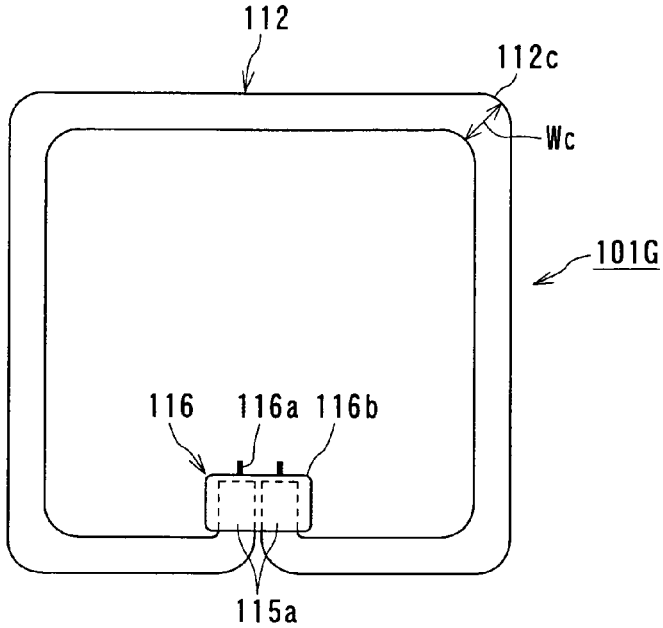
FIG. 22(*a*) is a front view of a fluorescent lamp according to a thirteenth embodiment of the present invention, and (*b*) is a partial enlarged view of an electrode sealing end portion of the fluorescent lamp of FIG. 22(*a*).
Figure 22B:
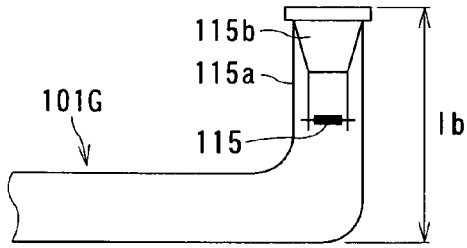
Figure 23A:
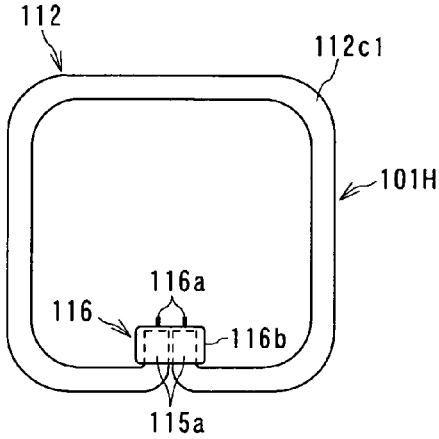
FIG. 23 (*a*) through (*e*) are front views of fluorescent lamps according to first through fifth modifications of the thirteenth embodiment of the present invention, respectively.
Figure 23B:
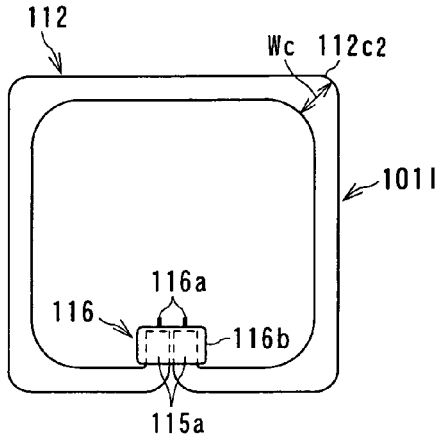
Figure 23C:
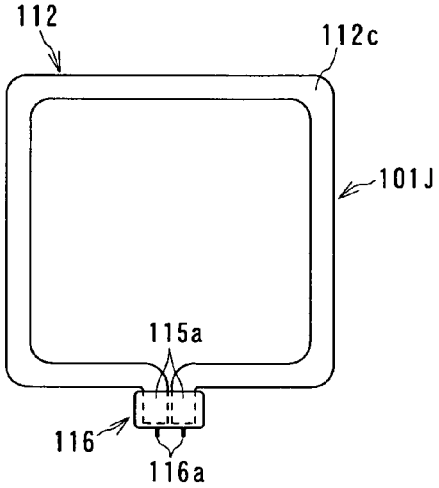
Figure 23D:
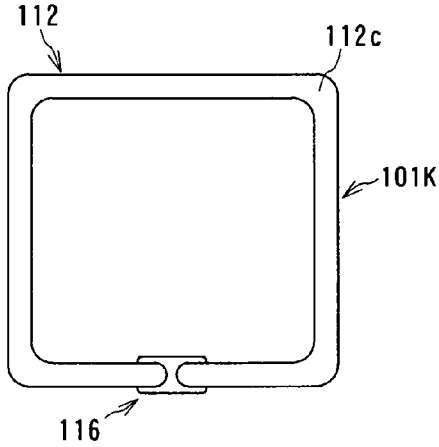
Figure 23E:
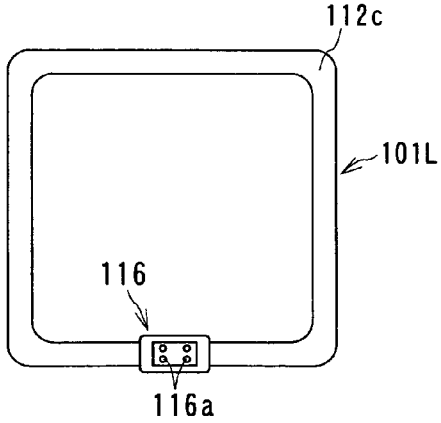

FIG. 22(*a*) is a front view representing a fluorescent lamp 101G of the fourteenth embodiment of the present invention. This embodiment has a seamless squared glass bulb 12 formed in an approximately box shape. The glass bulb 112 has a protective layer and fluorescent substance film formed on the inner surface thereof. Noble gas and mercury are sealed therein, and a pair of electrode sealing end portions 115*a*, 115*a* are formed by sealing a pair of electrodes 115, 115 at both end portions in the axial direction by line sealing or pinch sealing treatment. The paired electrode sealing end portions 115*a*, 115*a* are bent from the base portion thereof as shown in FIG. 22(*b*) in the parallel or vertical direction with respect to the single bending plane of the glass bulb 112 and inward to the squared glass bulb 112 so as to be arranged together horizontally as in FIG. 22 in a manner such that the portions other than the pair of electrode sealing end portions 115*a* and 115*a* form an approximately closed box shape. A base 116 shaped like a box cylinder is disposed on the outer surface of the paired electrode sealing end portions 115*a*, 115*a* so as to straddle the electrode sealing end portions 115*a*, 115*a*. The base 116 has a power supply member 116*b* composed of four pins 116*a*, for example, electrically connected to the paired electrodes 115 and 115.

According to the fluorescent lamp 101G, the glass bulb 112 has a ring shape structure closed in substantially box shape other at the light-emitting portions other than the pair of electrode sealing end portions 115*a* and 115*a* forming the dark portions, so that substantially the box shaped or ring shaped light emission can be realized without showing dark portions, thus improving the visual outer appearance.

Further, since the base 116 protrudes inside the squared shaped glass bulb 112 without projecting outward therefrom, the electrode sealing end portions 115*a* and 115*a* can be prevented or reduced from damaging during packing and shipping of the fluorescent lamp 101G, and in addition, an outside space of the glass bulb 112 can be effectively utilized.

Further, as shown in FIG. 22(*b*), although, in this embodiment, the electrodes 115 are mounted to a flare stem 115*b* within the fluorescent lamp 101G, the flare stem 115*b* may be replaced with a button stem. According to this modification, the button stem is disposed lower, in height, than the flare stem, so that the length 1*b* of the electrode sealing end portion 115*a* can be reduced by the length corresponding to this length so as to reduce the dark portion.

FIG. 23(*a*) through (*e*) are front views of fluorescent lamps 101H, 101I, 101J, 101K, and 101L, according to first through fifth modifications of the fourteenth embodiment of the present invention, respectively. The feature of the fluorescent lamp 101H according to the first modification shown in FIG. 23(*a*) resides in that the bent portions 112*c*1 is formed as arcs with a radius of curvature larger than the bent portion 112*c* of the fluorescent lamp 101G shown in FIG. 22(*a*), and structures other than this feature is the same as that of the fluorescent lamp 101G of the fourteenth embodiment mentioned above. In the following second to fifth modifications, substantially the same structure or configuration as that of the fourth embodiment will be adopted other than portions described hereunder with reference to FIG. 23(*b*) to (*e*).

The feature of the fluorescent lamp 1011 according to the second modification shown in FIG. 23(*b*) resides in that the bent portions 112*c*2 have been formed with a width greater than the bending width wc of the bent portions 112*c* of the fluorescent lamp 101G shown in FIG. 22(*a*). According to this feature, since the bent portions 112*c*2 has a large bending width wc as described above, the coldest portions can be formed at the bent portions 112*c*2.

The feature of the fluorescent lamp 101J according to the third modification shown in FIG. 23(*c*) resides in that the pair of electrode sealing end portions 115*a* and 115*a* are bent approximately parallel to the bending plane so as to protrude outwards from the squared shape of the glass bulb 112. According to this feature, since the pair of electrode sealing end portions 115*a* and 115*a* do not protrude inside the squared glass bulb 112, the squared inner space can be effectively utilized.

The features of the fluorescent lamp 101K according to the fourth modification illustrated in FIGS. 23(*d*) and (*e*) reside in that the pair of electrode sealing end portions 115*a* and 115*a* are bent so as to protrude towards the back side surface of the drawing of FIGS. 23 and (*d*) and front side surface thereof. According to this fluorescent lamp 101L, the electrode sealing end portions do not protrude inside or outside of the squared glass bulb 112, and the squared inner space and the outer space of the squared glass bulb 112 can be utilized effectively.

Figure 24:
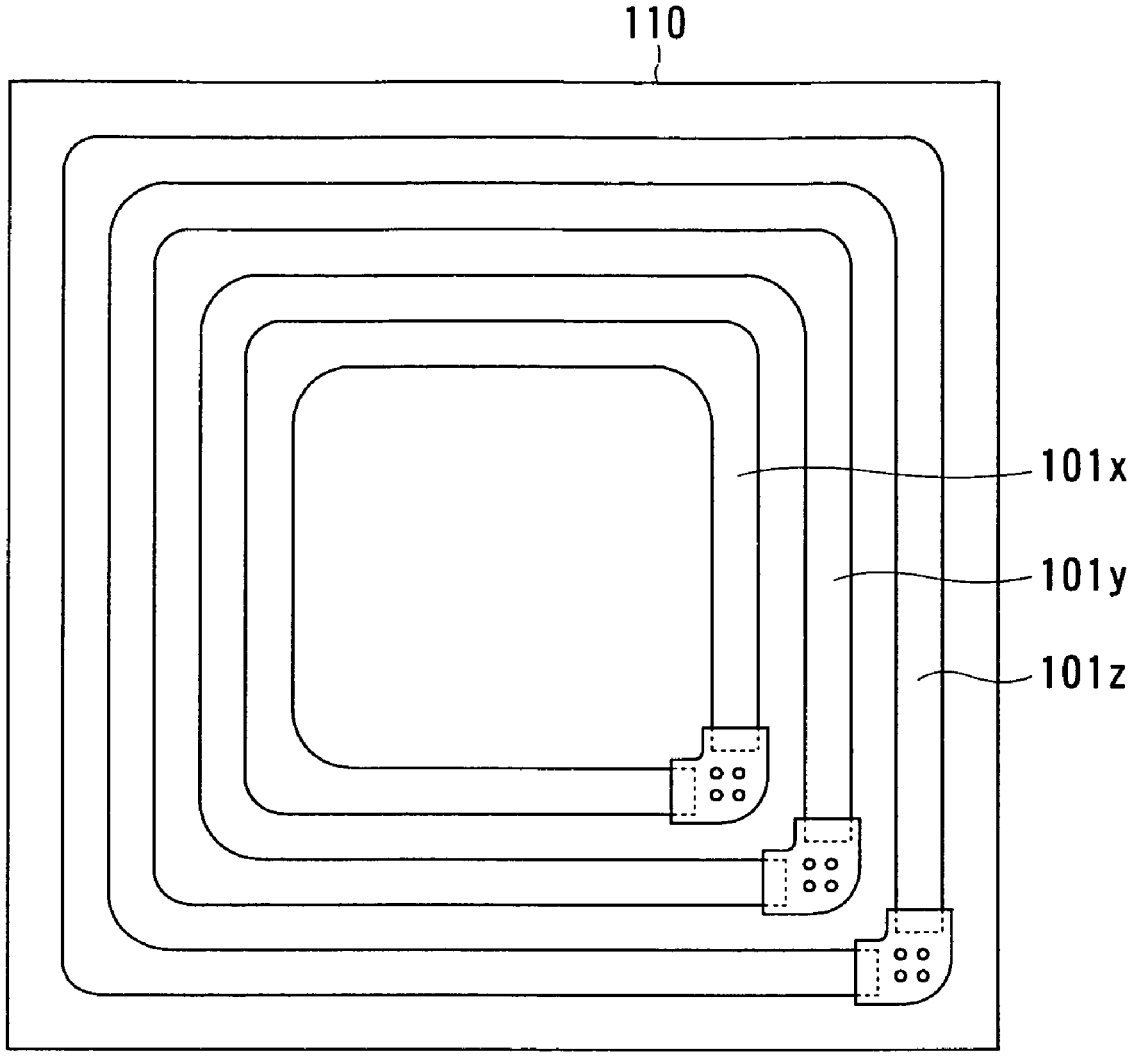
FIG. 24 is a schematic plan view illustrating a lighting fixture according to a fourteenth embodiment of the present invention.

FIG. 24 is a schematic plan view illustrating a lighting fixture or device according to the fifteenth embodiment of the present invention. The lighting fixture has a fixture (device) body 110 having a flat-plate shape and is disposed such that fluorescent lamps 101*x*, 101*y* and 101*z* are combined to this fixture body 110 in a concentric manner. As such fluorescent lamps 101*x* through 101*z*, any one of the fluorescent lamps 101A through 101L according to the eleventh to fourteenth embodiments or combinations thereof may be applied with no problem.

The fixture body 110 is provided with an inverter as a lighting device, not shown so as to supply the high-frequency lamp power, 10 kHz or higher to the fluorescent lamps 101*x*, 101*y*, and 101*z*, thus realizing the high-frequency lighting.

The fluorescent lamp 101*x* is equivalent to a conventional 30 W type ring-shaped fluorescent lamp with an entire length l of the glass bulb 102 of 225 mm, the greatest inner width of 192 mm, an outer tube diameter of 16 mm, and a wall thickness of the glass bulb 102 of 1.0 mm. The rated lamp power of the fluorescent lamp 101*x* is 20 W, and the lamp is lit at high-output-characteristic lamp power of 27 W.

The fluorescent lamp 101*y* is equivalent to a conventional 32 W type ring-shaped fluorescent lamp with an entire length 1 of the glass bulb 102 of 299 mm, the greatest inner width of 267 mm, an outer tube diameter of 16 mm, and a wall thickness of the glass bulb 102 of 1.0 mm. The rated lamp power of the fluorescent lamp 101*b* is 27 W, and the lamp is lit at the high-output-characteristic lamp power of 38 W.

The fluorescent lamp 101*z* is equivalent to a conventional 40 W type ring-shaped fluorescent lamp with an entire length l of the glass bulb 102 of 373 mm, the greatest inner width of 341 mm, an outer tube diameter of 16 mm, and a wall thickness of the glass bulb 102 of 1.0 mm. The rated lamp power of the fluorescent lamp 101*c* is 34 W, and the lamp is lit at the high-output-characteristic lamp power of 48 W.

Figure 25:
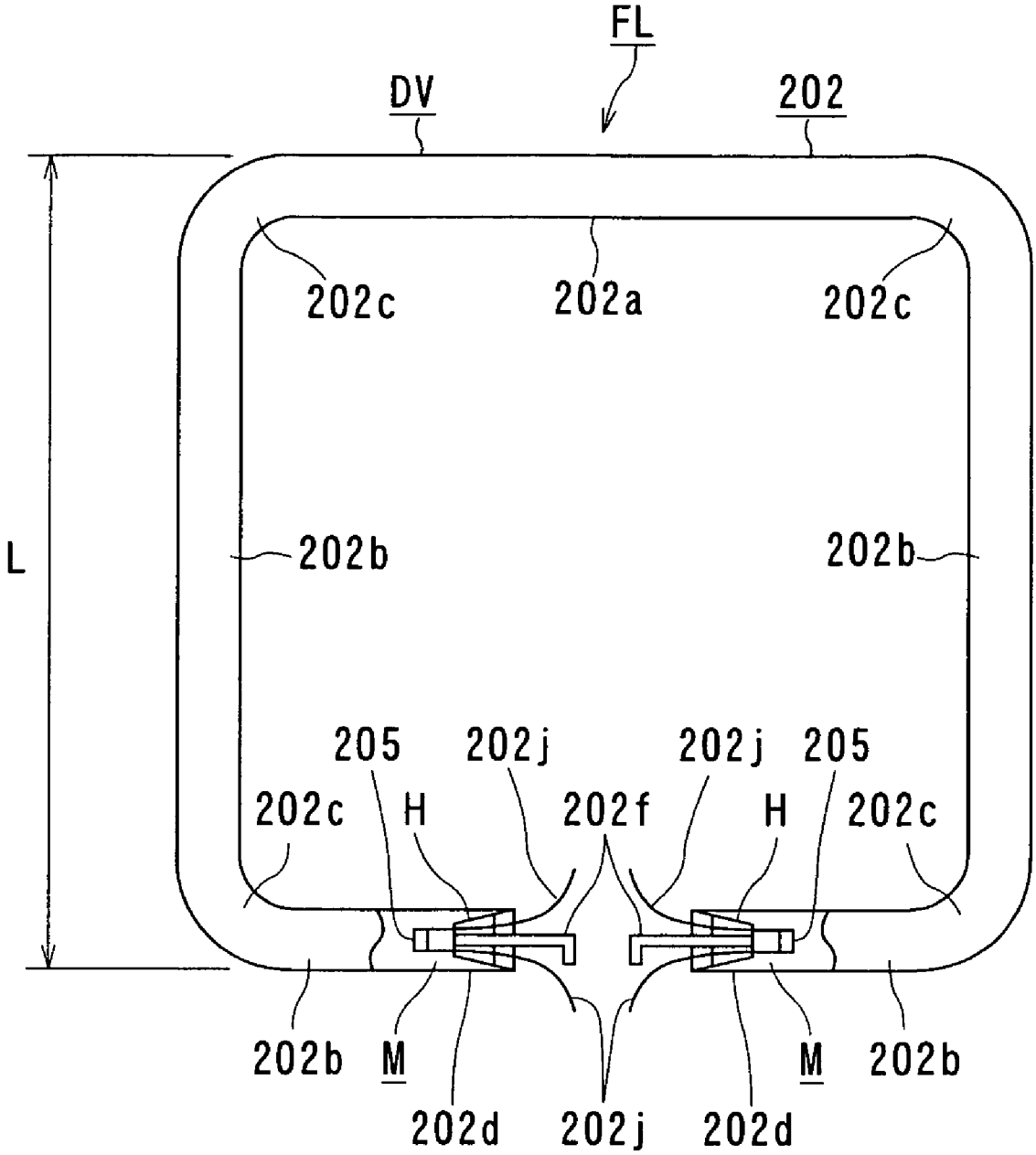
FIG. 25 is a front view of a wire lamp in a state with the base removed, illustrating a partially enlarged cross-sectional view of a fluorescent lamp according to a fifteenth embodiment of the present invention.
Figure 26:
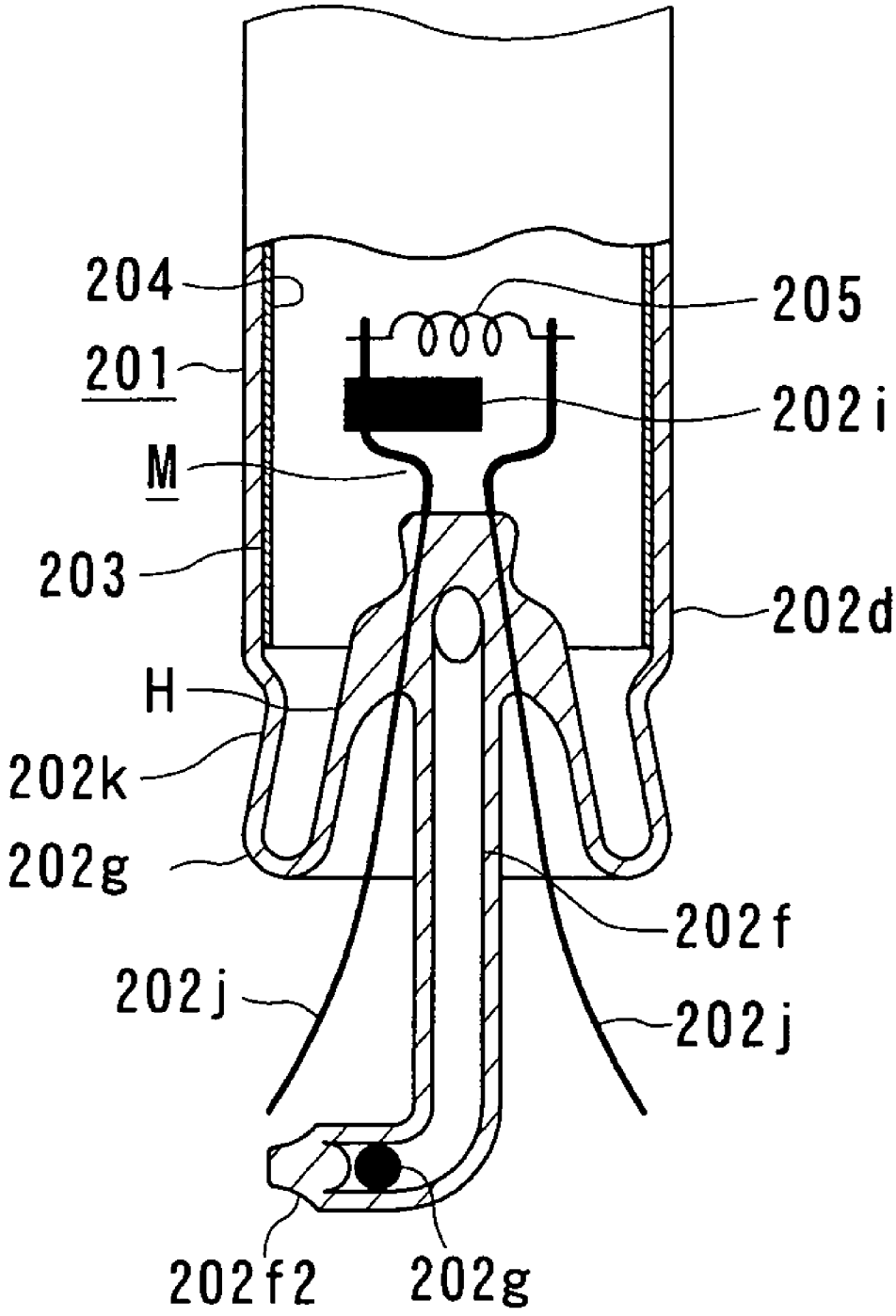
FIG. 26 is an enlarged cross-sectional view of the tube end portion of the fluorescent lamp shown in FIG. 25.
Figure 27A:
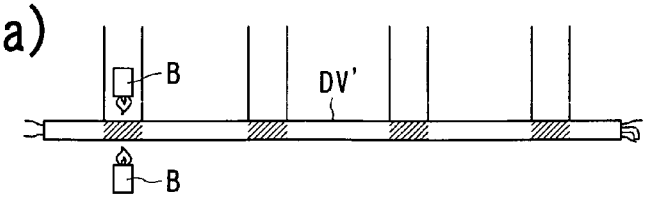
FIGS. 27(*a*), (*b*), (*c*), (*d*), and (*e*) are schematic illustrations representing steps for shaping the discharge vessel of the fluorescent lamp shown in FIG. 25.
Figure 27B:
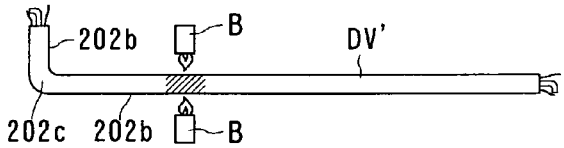
Figure 27C:
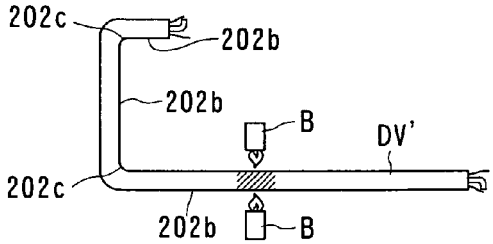
Figure 27D:
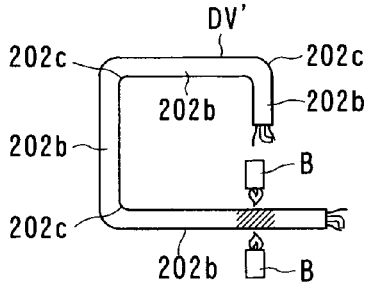
Figure 27E:
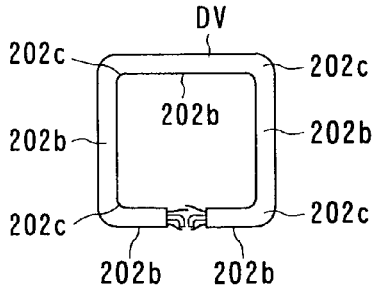

FIGS. 25 to 27 represent the sixteenth embodiment of the fluorescent lamp according to the present invention, in which FIG. 25 is a front view of a wire lamp in a state of the base being removed, FIG. 26 is an enlarged cross-sectional view of the tube end portion, and FIG. 27 includes illustrations for explaining the steps of shaping the discharge vessel.

In these drawings, the fluorescent lamp FL is provided with a discharge vessel DV and a base B. The discharge vessel DV is an approximate quadrate in its entire structure and has one bent discharge path therein. Further, the discharge vessel DV comprises a glass bulb 202, a protective layer 203, a phosphor layer 204, and a pair of electrodes 205 and 205. The discharge vessel further includes a discharge medium containing amalgam 202*g* and 202*g* sealed therein.

The glass bulb 202 is formed by locally heating, softening and bending a single straight cylindrical glass tube so as to provide an approximate quadrate shape entirely. Three straight tube portions 202*b* and two short straight tube portions 202*b* forming the four sides of the square shape, and four bent portions 202*c* forming the corner portions and a pair of ends 202*d* are connected and disposed on the same plane. The pair of tube end portions 202*d* and 202*d* comprise a pair of fine tubes 202*f* and 202*f*.

The three straight tube portions 202*b* make up three adjacent sides of the quadrate shape, and the two short straight tube portions 202*b* extend in mutually opposing directions so as to constitute the remaining one side. The bent portions 202*c* connect the adjacent pair of straight tube portions 202*b* at right angles. The pair of ends 202*d* and 202*d* are composed of the free ends of a pair of straight tube portions 202*b* and 202*b* and are sealed before the bending of the glass tube by sealing flare stems S of respective electrode mounts M to the ends of the glass bulb.

The electrode mount M is an assembly composed of a flare stem H, a fine tube 202*f*, an electrode 205 and a lead wire 202*j*, which are preliminarily assembled, and a pair of such assemblies are sealed in the glass tube by fusing the flare portion of the flare stem H to the end portions 202*d* of the glass tube. Then, the glass bulb 202 is sealed off, and as mentioned hereinlater, the fine tube 202*f* is connected to the glass bulb 202, the electrodes 205 are sealed and the lead wires 202*j* extend from the electrodes 205. As shown FIG. 26, both the end portions 202*d* of the glass bulb 202 are subjected to mold shaping at the time of sealing the flare stem H, thereby forming a narrow portion 202*k*.

The pair of fine tubes 202*f* extend outwards from the pair of ends 202*d* of the glass bulb 202. The inner ends of the fine tubes 202*f* communicate with exhausting holes in the glass bulb 202. On the other hand, the outer ends of the fine tubes 202*f* are sealed with the inner face protruding inwards, as shown in FIG. 26. Furthermore, the paired fine tubes 202*f* are bent at the front ends thereof so as to provide approximately right angles in parallel to each other and extend in directions approximately orthogonal to the tube axis. Further, the paired fine tubes 202*f* extend in a long shape before the tips 202*f*2 are sealed.

Next, the method for manufacturing the fluorescent lamp FL according to the present embodiment will be described with reference to FIG. 27.

This manufacturing method is approximately the same as the manufacturing method described with reference to FIG. 2, and therefore, only points differing from the method shown in FIG. 2 will be described hereunder in detail.

First, as shown in FIG. 27(*a*), a first bent-portion-formation preordination portion is heated and softened with a gas burner B, and as shown in FIG. 27(*b*), the bending is performed so as to provide the angle between straight tube portions 202*b* and 202*b* to be 90°, following which a first bent portion 202*c* is formed to a predetermined shape by molding or like step. Subsequently, the bent-portion-formation preordination portion adjacent to the first bent portion 202*c* is also heated and softened with the gas burner B and subjected to the bending and molding steps, thereby forming the second bent portion 202*c* as shown in FIG. 27(*c*). Similarly, the bent-portion-formation preordination portions are sequentially heated and softened with the gas burner B and subjected to the bending and molding steps as shown in FIGS. 27(*d*) and (*e*), thereby forming the discharge vessel DV to be the quadrate shape such as shown in FIG. 25 with the four bent portions 202*c* being formed. Furthermore, the middle portions of the paired fine tubes 202*f* and 202*f* are bent approximately at right angles downwards in the drawing such that the tip portions thereof extend parallel in a long shape. The fine tubes 202*f* are shortened at the time of being sealed after the sealing in the discharge medium.

In the exhausting/sealing process, the discharge medium is sealed after the exhaust of the interior of the discharge vessel DV. The pair of fine tubes 202*f* and 202*f* extending from the pair of ends 202*d* of the discharge vessel DV are connected to an exhausting device, not shown, and the discharge vessel DV is simultaneously drawn from both end sides 202*d*. Accordingly, exhaust is surely performed, even in the case of the discharge vessel having a polygonal shape. Following this exhausting step, the noble gas and amalgam 202*g* is sealed into the discharge vessel DV by way of one of the fine tubes 202*f*. Subsequently, the middle portion of the pair of fine tubes 202*f* are heated and melted so as to close the tip of the portion remaining on the discharge vessel DV side, thereby performing the sealing step. The inner surface of the tip portions 202*f*2 of the fine tubes 202*f*, sealed in this manner, protrude inward.

The other embodiments of the fluorescent lamp LF according to the present invention will be further described hereunder with reference to FIG. 28 through FIG. 32. Note that in the drawings, same or like reference numerals are added to portions or members corresponding to those shown in FIG. 25 through FIG. 27 and descriptions thereof are omitted herein.

Figure 28A:
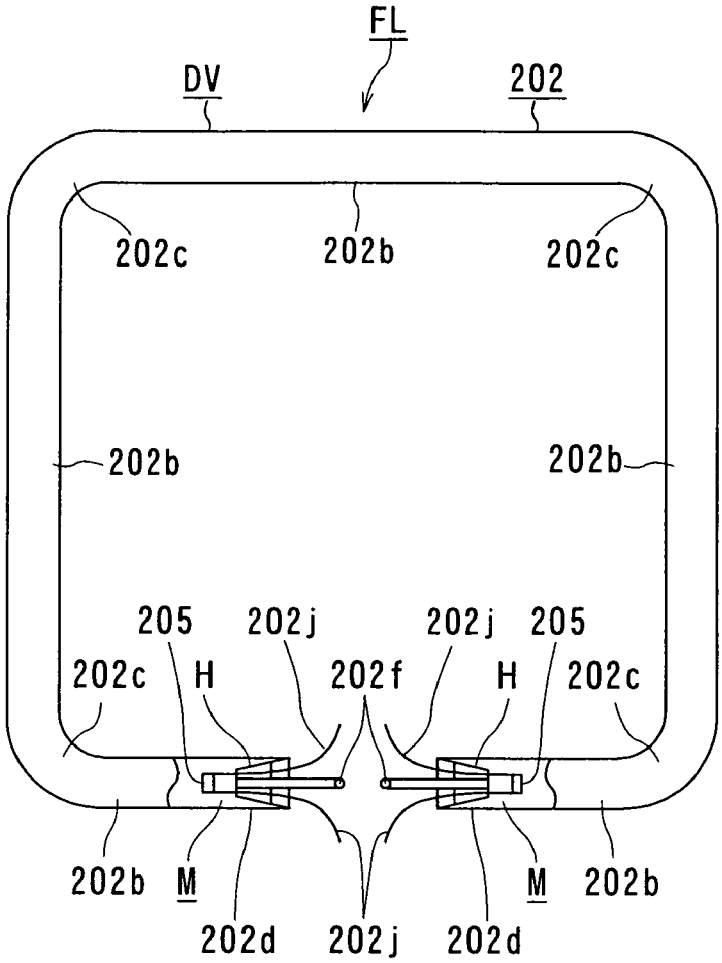
FIG. 28(*a*) is a schematic view, partially cutaway view, of a discharge vessel before exhaust, according to a sixteenth embodiment of the present invention, and (*b*) is a side view thereof.
Figure 28B:
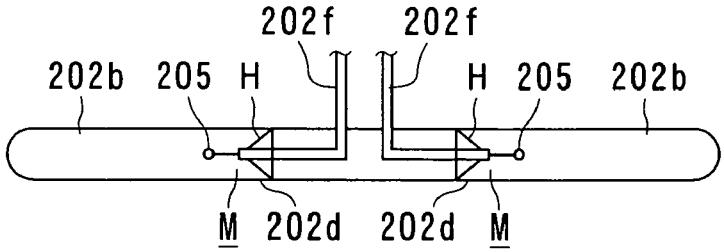

FIG. 28 illustrates the seventeenth embodiment of the present invention, in which FIG. 28(*a*) is a schematic view of a discharge vessel, partially cut away, before the exhaust step, and FIG. 28(*b*) is a side view thereof. This embodiment differs in that the middle portion of the fine tubes 208*f* of this embodiment is bent at a right angle to the plane including the polygonal portion of the glass bulb 202. Such structure is advantageous for the exhausting/sealing device.

Figure 29A:
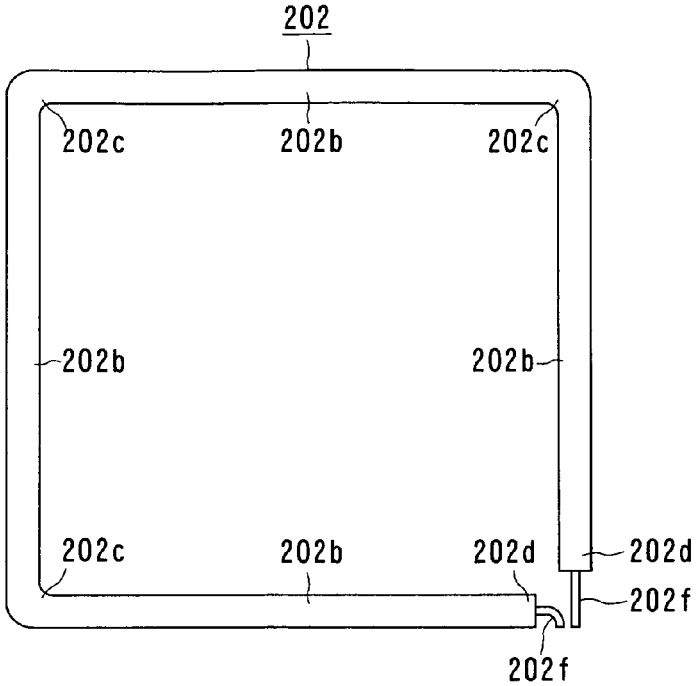
FIG. 29(*a*) is a front view of a wire lamp in a state with the base removed, according to a seventeenth embodiment of the present invention, and (*b*) is a front view of a wire lamp according to an eighteenth embodiment of the present invention.
Figure 29B:
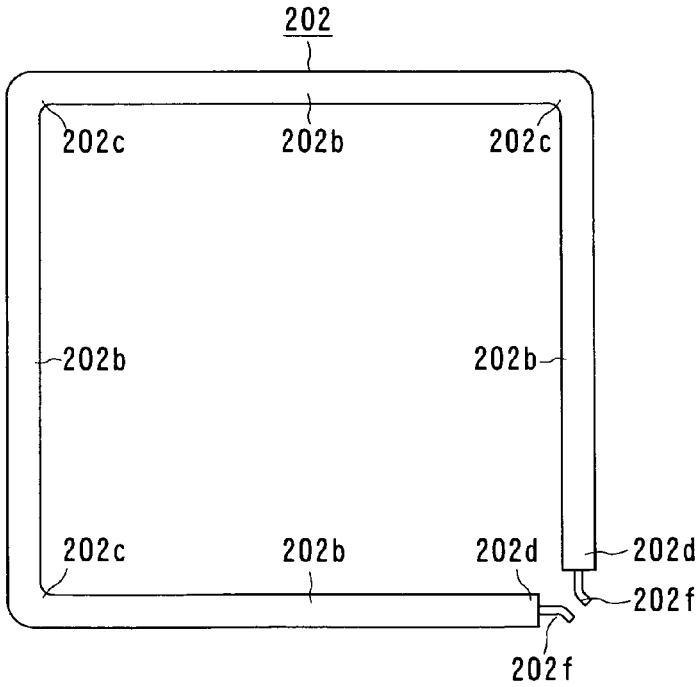

FIG. 29(*a*) represents the eighteenth embodiment of the present invention and is a front view of a wire lamp in a state of the base being removed.

That is, the glass bulb 202 is formed of the three bent portions 202*c* and the pair of fine tubes 202*f*. The end 202*d* of the free end sides of the straight tube portions 202*b* are arranged in close proximity to each other at approximately right angles on both ends thereof.

As shown in FIG. 29(*a*), one fine tube 202*f* protruding from the end 202*d* of the straight tube portion 202*b* extending vertically of one glass bulb 202 extends straight with respect to the tube axis. On the other hand, the fine tube 202*f* protruding from the end 202*d* of the straight tube portion 202*b* extending horizontally in the drawing of one glass bulb 202 bends approximately at a right angle at the middle portion thereof to make approximately parallel to one fine tube 202*f*.

FIG. 29(*b*) is a front view of a wire lamp according to the nineteenth embodiment of the present invention. In this embodiment, the configuration of the pair of fine tubes 202*f* differs from the lamp of, in comparison, the glass bulb 202 according to the embodiment shown in FIG. 29(*a*).

That is, the pair of fine tubes 202*f* both curve gently at the middle portion so that the front ends thereof extend generally in parallel towards the outer side along the diagonal line of the square shape.

Figure 30:
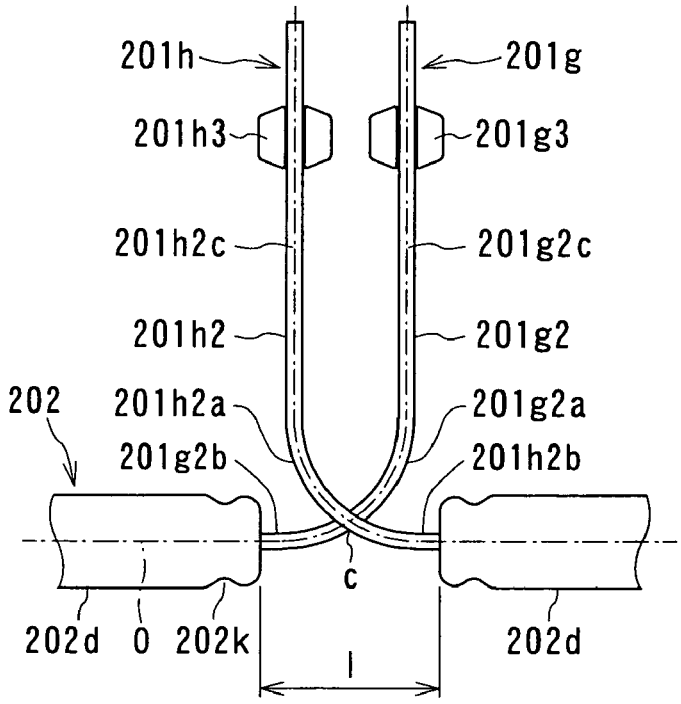
FIG. 30 is a side view, in an enlarged scale, of a pair of fine tubes and the periphery thereof, according to a nineteenth embodiment of the present invention.
Figure 31:
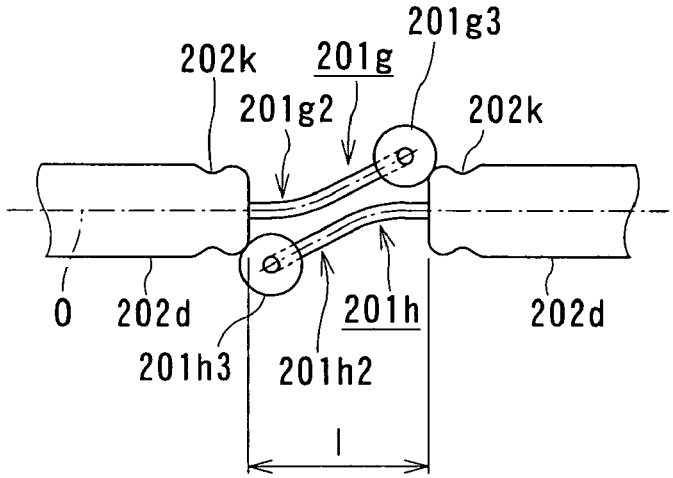
FIG. 31 is a plan view of FIG. 30.
Figure 32:
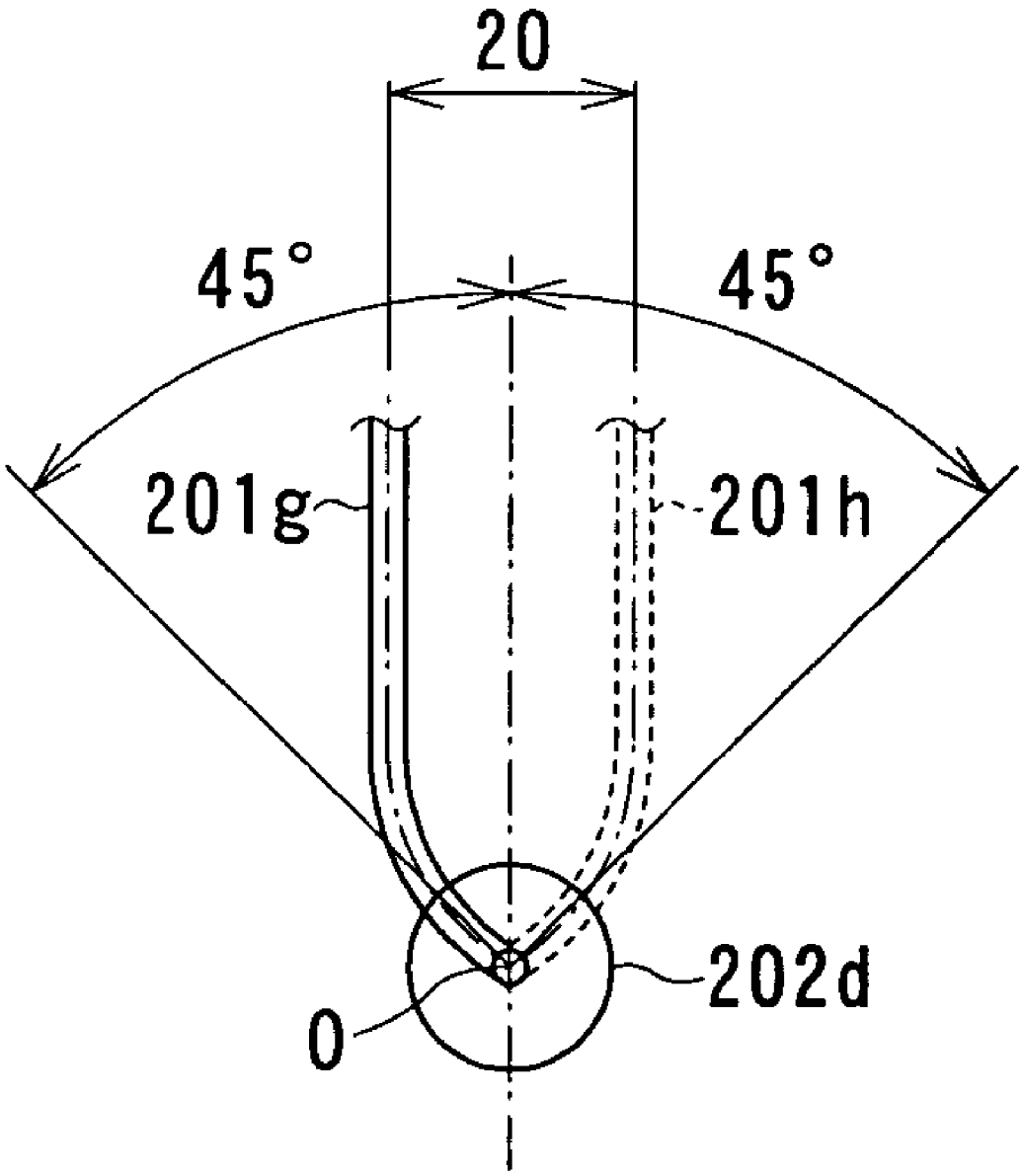
FIG. 32 is a view illustrating the angle of inclination of the pair of fine tubes shown in FIG. 30 and FIG. 31.

FIG. 30 through FIG. 32 represent the twentieth embodiment of the present invention, a feature of this embodiment resides in a pair of fine tubes 201*g* and 201*h* having a shape improved over the fine tubes 202*f* and 202*f* illustrated in FIG. 28(*b*). Other than such shape or structure, the configuration is the same as the pair of fine tubes 202*f* and 202*f*.

That is, the inner end portions of the paired fine tubes 201*g* and 201*h* are communicated with the inside portion of the glass bulb 202, and these tubes extend in the axial direction thereof such as fine tubes 202*f* and 202*f* shown in FIG. 28 with the outer end portions 201*g*2 and 201*h*2 extending outward from the pair of ends 202*d* and 202*d* of the glass tube 202.

As shown in FIG. 30 and in FIG. 31 which is a plan view of FIG. 30, the middle portions of the outer end portions 201*g*2 and 201*h*2 of the pair of fine tubes 201*g* and 201*h* are curved in an arc shape so as to extend perpendicularly, and both curved portions 201*g*2*a* and 201*h*2*a* thereof intersect in the direction penetrating the drawing paper in FIG. 30 (in the diameter direction of the exhaust tubes 201*g* and 201*h*) with a predetermined gap therebetween.

That is, as shown in FIG. 30 and FIG. 31, the outer end portions 201*g*2 and 201*h*2 of the pair of fine tubes 201*g* and 201*h* are formed with the same shape and same size, and the horizontal portions 201*g*2*b* and 201*h*2*b* extending in the parallel direction along the center axis O of the end portions 202*d* toward the end portion id at the other side (opposing side), the curved portions 201*g*2*a* and 201*h*2*a* and the standing portions 201*g*2*c* and 201*h*2*c* standing perpendicularly from the curved portions 201*g*2*a* and 201*h*2*a* are integrally formed continuously from one of the paired end portions 202*d* and 202*d* of the glass bulb 202.

That is, as shown in FIG. 31, the horizontal portions 201*g*2*b* and 201*h*2*b* of the pair of fine tube outer end portions 201*g*2 and 201*h*2 extend towards the mutually opposing end portions 202*d* and 202*d* of the glass bulb 202 along the central axis O thereof, and in order to avoid collision of these two portions, the tip portions thereof are formed to be continuous into straight-tube shaped standing portions 201*g*2*c* and 201*h*2*c* in an arc shape in the erecting direction (perpendicular direction) as shown in FIG. 30 with an inclination of a predetermined angle (exhaust tube protrusion angle) towards the front and back directions of the inner side and outer side of the quadrate structure of the glass bulb 202 at a point just before the center point C at which the front ends come into contact to each other.

At this time, the gap 1 between the pair of end portions 202*d* and 202*d* of the glass bulb 202 is formed to be 30 mm, for example, the curvature radius R of the curved portions 201*g*2*a* and 201*h*2*a* to be 20 mm, and the exhaust tube protrusion angle formed to be 45° in mutually opposing directions as shown in FIG. 32. Further, that the curvature radius R may be preferably within 15 mm to 30 mm.

Further, the reference numerals 201*g*3 and 201*h*3 in FIG. 30 and FIG. 31 denote a pair of ring-shaped rubbers externally fitted and fixed to the erected portions 201*g*2*c* and 201*h*2*c* of the pair of fine tubes 201*g* and 201*h*. In the exhausting step, opened front ends of a vacuum pump head of an exhausting device, not shown, are externally fitted in an airtight manner to the outer surface of the ring shaped rubbers 201*g*3 and 201*h*3, so that the inside of the glass bulb

201 is evacuated, and subsequent to this exhausting step, the discharge medium is supplied into the glass bulb 201 and sealed therein. Following the exhausting and sealing steps, the exhaust tube outer end portions 201*g*2 and 201*h*2 are pinched off by a predetermined lengths so as to be stored in the base B and covered. Four electricity receiving pins 207, for example, are disposed to stand on the outer circumference of the base B, and the electricity receiving pins 7 are electrically connected to the four lead wires 201*g*, respectively, at the inner ends thereof.

According to this fluorescent lamp FL, although the glass bulb 202 can be evacuated by the pair of fine tubes 201*g* and 201*h* almost simultaneously from both ends thereof, the discharge medium may be sealed in almost simultaneously from both ends of the glass bulb 202 through the pair of fine tubes 201*g* and 201*h*. Accordingly, even in the case where the glass bulb 202 is long and polygonal shape, the exhausting is well performed, so that residual impure gasses in the discharge vessel are dramatically reduced. Consequently, the luminous flux maintenance factor of the fluorescent lamp is markedly improved.

In addition, since the curvature radius of the curved portions 201*g*2*a* and 201*h*2*a* of the pair of fine tubes 201*g* and 201*h* is 15 to 30 mm, the mercury inserted from the fine tubes 201*g* and 201*h* smoothly moves through the erected portions 201*g*2*c* and 201*h*2*c* and horizontal portions 201*g*2*b* and 201*h*2*b* of the fine tubes 201*g* and 201*h* with own weight and is hence inserted into the glass bulb 202.

Thus, the mercury can be sealed into the glass bulb 202 speedily and surely, and the sealing efficiency can be improved.

Furthermore, in the case where the curvature radius of the curved portions 201*g*2*a* and 201*h*2*a* of the pair of tine tube outer end portions 201*g*2 and 201*h*2 is smaller than 15 mm, the erecting angle of the curved portions 201*g*2*a* and 201*h*2*a* becomes a sharp angle, closer to a right angle, leading to a difficulty in inserting mercury into the fine tube outer end portions.

On the other hand, in the case where the curvature radius of the curved portions 201*g*2*a* and 201*h*2*a* exceeds 30 mm, the erecting angle of the curved portions 201*g*2*a* and 201*h*2*a* becomes a blunt angle. Accordingly, the amount of enlargement of the erected portions 201*g*2*c* and 201*h*2*c* of the fine tubes 201*g* and 201*h* enlarging towards the sealing end sides 201*d* of the glass bulb 201 increases, leading to enlargement of the gap between the pair of sealing end portions 202*d* and 202*d*, causing a problem of reduced lamp efficiency.

According to the present embodiment, since the curved portions 201*g*2*a* and 201*h*2*a* of the fine tubes 201*g* and 201*h* have a curvature radius of 15 to 30 mm, the problems mentioned above could be eliminated beforehand.

In addition, since the horizontal portions 201*g*2*b* and 201*h*2*b* of the pair of the outer end portions 201*g*2 and 201*h*2 of the fine tubes 201*g* and 201*h* are inclined so that the center axes thereof are mutually offset, the horizontal portions 201*g*2*b* and 201*h*2*b* of the pair of the outer end portions 201*g*2 and 201*h*2 of the fine tubes 201*g* and 201*h* could be extended near the sealing end portions 201*d* and 201*d* without contacting (colliding) the horizontal portions 201*g*2*b* and 201*g*2*b* with each other.

Accordingly, the length of the horizontal portions 201*g*2*b* and 201*h*2*b* of the pair of fine tubes 201*g* and 201*h* can be made longer without enlarging the gap between the pair of sealing end portions 202*d* and 202*d* of the glass bulb 202 which are dark portions, thereby allowing the radius of curvature of the curved portions 201*g*2*a* and 201*h*2*a* to be easily made larger without increasing the dark portions.

Furthermore, since shape of the glass bulb 202 is formed into a rectangular ring, and the pair of sealing end portions 202*d* and 202*d* which are the axial end portions of the ring shape are disposed facing one another with a predetermined gap l therebetween, even in the case where the glass bulb 202 has the long axial length, the pair of fine tubes 201*g* and 201*h* standing on the pair of sealing end portions 202*d* and 202*d* are disposed in mutually close positions, so that the exhausting processing can be easily performed via the pair of fine tubes 201*g* and 201*h*. Moreover, the exhaust of the glass bulb 202 can be simultaneously performed via the pair of fine tubes 201*g* and 201*h* standing on both the sealing end portions 202*d* and 202*d* of the glass bulb 202, so that the exhaust can be surely performed even in the case of the polygonal, such as quadrate, glass bulb 202. Accordingly, the luminous flux maintenance factor of the obtained fluorescent lamp FL can be improved.

It is further to be noted that the embodiments described above have been proposed with reference to the cases in which the glass bulb is formed in the quadrate shape, the present invention is not restricted to this shape and may be applied to any other shape such as rectangular, circular, or double-ring shaped bulbs, and like. The outer diameter and axial direction length of the glass bulb is not also restricted to those described with reference to the embodiments mentioned above.

INDUSTRIAL APPLICABILITY

As described above, according to the fluorescent lamp of the present invention mentioned above, thermal deterioration of the phosphor layer formed in the straight tube portion can be reduced and deterioration in the initial light flux can be suppressed, enabling lighting a higher efficiency.

Furthermore, there is provided a fluorescent lamp, which is thin due to the small tube diameter, is capable of lighting with high efficiency with improved light output characteristics, and has an excellent luminous flux maintenance factor.

The invention claimed is:

1. A fluorescent lamp comprising:

a bulb including:

a plurality of bent portions and straight tube portions each having an external tube diameter of 12 to 20 mm and a tube length of 800 to 2500 mm in an arrangement in which the straight portions are disposed generally within the same plane through the bent portions;

a pair of end portions disposed closely to each other and provided with electrodes sealed therein so as to form a single discharge path through the straight tube portions and bent portions;

a phosphor layer formed on the inner surface of the bulb; and a discharge medium including mercury sealed in the bulb; and a base provided on the end portions of the bulb.

2. A fluorescent lamp according to claim 1, wherein the bent-portion-formation preordination portion is bent so that a radius of curvature at the inner surface of the bent portion is in a range of 1 to 3 times an inner diameter of the tube, and an amount ($mg/cm^2$) of a phosphor layer adhering to the bent portions is ½ or more of that at the straight tube portion.

3. A fluorescent lamp according to claim 1, wherein an application amount of phosphor particles making up the phosphor layer at the straight tube portions is 4.0 to 7.5 $mg/cm^2$.

4. A fluorescent lamp according to claim 1, wherein a protective layer of 0.5 μm or more in thickness is formed on the inner surface of the bulb, and the phosphor layer is formed on the protective layer.

5. A fluorescent lamp according to claim 1, wherein the length of the bent-portion-formation preordination portions is within a range of 5 to 50% of an entire length of the straight-tube-shaped bulb.

6. A fluorescent lamp according to claim 1, wherein the bulb is formed in substantially a quadrate shape from five straight tube portions with bent portions formed at each of diagonal line positions of the quadrate shape, with the bases provided on both end portions of the bulb at substantially a central portion of one side of the quadrate shape.

7. A fluorescent lamp according to claim 1, wherein the base is provided with a turn restricting element for restricting a turning angle of the base with respect to the end portions of the bulb to an angle less than a predetermined angle.

8. A fluorescent lamp according to claim 1, wherein the turn restricting element is formed by constructing the base and the end portions of the bulb to which the base is fitted so as to provide elliptical shapes in the axial cross-sectional shape.

9. A fluorescent lamp according to claim 1, wherein the turn restricting element is an engaging element formed on at least one of both joint portions of the base and the end portions of the bulb to which the base is fitted and adapted to restrict the turning of the base exceeding a predetermined angle by engaging the base.

10. A fluorescent lamp according to claim 1, wherein a coldest portion to be maximally cooled is formed to at least one of the bent portions at a time of lighting.

11. A fluorescent lamp according to claim 10, wherein a maximum length of an inner tube diameter at the bent portion is 1.2 times or more an inner tube diameter of the straight tube portion.

12. A fluorescent lamp according to claim 10, wherein at the bent portions, one tip end of adjacent straight tube portions extends in an axial direction of the straight tube portion so as to project beyond a connecting portion.

13. A fluorescent lamp comprising:

a discharge vessel having a glass bulb formed by partially bending a glass tube having an external tube diameter of 12 to 20 mm and a tube length of 800 to 3000 mm so as to form a plurality of straight tube portions and bent portions, which are alternately adjacently arranged, within a same plane, such that both end portions provide straight tube portions so as to be adjacent one another so as to provide entirely a polygonal shape, the glass bulb being provided with a pair of sealed fine tubes for discharge extending from both end portions of the glass bulb, a phosphor layer formed on the inner surface side of the glass bulb, a pair of electrodes sealed on an inner side of both end portions of the glass bulb, and a discharge medium sealed within the glass bulb; and a base provided to both the end portions of the bulb.

14. A fluorescent lamp according to claim 13, wherein a part of at least one of the paired fine tubes is bent so that the paired fine tubes extend generally parallel to each other.

15. A fluorescent lamp according to claim 13, wherein center axes of horizontal portions of the paired fine tubes extending in horizontal directions on the sides of the mutually opposing bulb end portion are arranged so as to be offset one another.

16. A lighting apparatus comprising:

a lighting apparatus main unit;

a fluorescent lamp disposed in the lighting apparatus main unit and including a bulb, including: a plurality of bent portions and straight tube portions adjacent to the bent portions each having an external tube diameter of 12 to 20 mm and a tube length of 800 to 2500 mm in an arrangement in which the straight portions are disposed generally within the same plane through the bent portions; a pair of end portions disposed closely to each other and provided with electrodes sealed therein so as to form a single discharge path through the straight tube portions and bent portions; a phosphor layer formed on the inner surface of the bulb; and a discharge medium including mercury sealed in the bulb: and a base provided on the end portions of the bulb; and a high-frequency lighting circuit which lights the fluorescent lamp by applying high-frequency voltage of frequency of 10 kHz or higher thereto.

17. A method of manufacturing a fluorescent lamp comprising the steps of:

forming a discharge vessel having a straight-tube-shaped glass bulb, in which a phosphor layer is disposed on an inner surface of a glass tube having an external tube diameter of 12 to 20 mm and a tube length of 800 to 3000 mm, and electrode mounts for supporting electrodes and having a pair of fine tubes are sealed at the end portions of the glass tube;

shaping the discharge vessel, in which the straight-tube-shaped glass bulb is partially heated to be softened and then bent so as to alternately form a plurality of tube portions so as to be adjacent to each other and bent portions within a same plane such that both the end portions constitute straight tube portions and are adjacent one another so as to provide an entirely polygonal shape;

exhausting the interior of the discharge vessel from each of the paired fine tubes extending from the end portions of the glass bulb following the discharge vessel shaping step and, subsequently, sealing in a discharge medium and then sealing off the fine tubes; and disposing a base on both end portions of the discharge vessel.

18. A manufacturing method according to claim 17, wherein the pair of fine tubes extend in the horizontal direction on the sides of the mutually opposing bulb end portions and has a bent portion curving with a curvature radius of 15 to 30 mm.

* * * * *